US008336349B2

(12) United States Patent
Thimmappa et al.

(10) Patent No.: US 8,336,349 B2
(45) Date of Patent: Dec. 25, 2012

(54) LOCK ASSEMBLY

(75) Inventors: Lohithaswa Thimmappa, Colorado Springs, CO (US); Evan E. Evans, Colorado Springs, CO (US); Vinod Kumar Rajan, Colorado Springs, CO (US); Aravinda Mahabaleshwara, Colorado Springs, CO (US); Ravindra K. Pandey, Oviedo, FL (US); Roger Kanaan, Williamston, SC (US)

(73) Assignee: Schlage Lock Company, Carmel, IN (US)

( * ) Notice: Subject to any disclaimer, the term of this patent is extended or adjusted under 35 U.S.C. 154(b) by 654 days.

(21) Appl. No.: 12/424,224

(22) Filed: Apr. 15, 2009
(Under 37 CFR 1.47)

(65) Prior Publication Data

US 2010/0116007 A1 May 13, 2010

Related U.S. Application Data

(60) Provisional application No. 61/124,243, filed on Apr. 15, 2008, provisional application No. 61/124,919, filed on Apr. 21, 2008, provisional application No. 61/131,610, filed on Jun. 9, 2008.

(51) Int. Cl.
*E05B 9/04* (2006.01)

(52) U.S. Cl. ..... 70/371; 70/367; 70/369; 70/375; 70/493

(58) Field of Classification Search ..... 70/367–373, 70/375, 378, 493
See application file for complete search history.

(56) References Cited

U.S. PATENT DOCUMENTS

| | | | | |
|---|---|---|---|---|
| 1,100,245 | A * | 6/1914 | Kimball | 70/374 |
| 2,347,802 | A * | 5/1944 | Voight | 70/369 |
| 3,324,693 | A * | 6/1967 | Check | 70/369 |
| 4,328,690 | A * | 5/1982 | Oliver | 70/369 |
| 4,444,033 | A * | 4/1984 | Deckert | 70/493 |
| 4,823,575 | A | 4/1989 | Florian et al. | |
| 4,850,210 | A * | 7/1989 | Adler et al. | 70/383 |
| 5,070,715 | A | 12/1991 | Smallegan et al. | |
| 5,161,397 | A * | 11/1992 | Raybary | 70/374 |
| 5,233,851 | A * | 8/1993 | Florian | 70/367 |
| 5,325,690 | A * | 7/1994 | Adler et al. | 70/383 |
| 5,507,163 | A * | 4/1996 | Juang | 70/369 |
| 5,752,400 | A * | 5/1998 | Kim | 70/368 |
| 5,884,512 | A * | 3/1999 | Wayne | 70/370 |
| 6,382,006 | B1 * | 5/2002 | Field et al. | 70/371 |
| 6,578,396 | B2 * | 6/2003 | Field et al. | 70/371 |
| 6,718,807 | B2 * | 4/2004 | Andersson | 70/371 |
| 6,948,345 | B1 * | 9/2005 | Ruan | 70/370 |
| 7,003,994 | B2 * | 2/2006 | Ruan | 70/416 |
| 7,716,958 | B2 * | 5/2010 | Martin | 70/78 |
| 7,836,735 | B2 * | 11/2010 | Liu | 70/81 |
| 2005/0011239 | A1 * | 1/2005 | Lurie et al. | 70/369 |
| 2005/0199027 | A1 * | 9/2005 | Mannella | 70/379 R |
| 2007/0227209 | A1 * | 10/2007 | Massard et al. | 70/371 |
| 2008/0016928 | A1 * | 1/2008 | Yang et al. | 70/367 |
| 2009/0241620 | A1 * | 10/2009 | Field et al. | 70/360 |

* cited by examiner

*Primary Examiner* — Suzanne Barrett
(74) *Attorney, Agent, or Firm* — Michael Best & Friedrich LLP

(57) ABSTRACT

A method of manufacturing a lock assembly for enabling use of a key-in-knob lock cylinder assembly in different types of lock assemblies. The method includes providing a key-in-knob lock assembly having a key-in-knob housing and a plug rotatably engaged within the key-in-knob housing, providing an interchangeable core lock assembly having an interchangeable core housing, and inserting the key-in-knob housing into the interchangeable core housing such that the key-in-knob housing is universally exchangeable between the key-in-knob lock assembly and the interchangeable core lock assembly.

29 Claims, 28 Drawing Sheets

LOCK ASSEMBLY

RELATED APPLICATIONS

This patent application claims priority to U.S. Patent Application Ser. No. 61/124,243 filed Apr. 15, 2008, U.S. Patent Application Ser. No. 61/124,919 filed Apr. 21, 2008, and U.S. Patent Application Ser. No. 61/131,610 filed Jun. 9, 2008, the entire contents of which are hereby incorporated by reference.

BACKGROUND

The invention relates to a lock assembly for a door. More particularly, the invention relates to a lock assembly that includes a housing and a plug.

Generally, some lock assemblies include a housing and a plug that define respective pin chambers to receive pin pairs. The pin pairs include outer pins substantially disposed within the housing, and inner pins disposed within the plug. Springs are often used to bias the pin pairs toward a key slot defined in the plug. More specifically, the springs are engaged with the outer pins, which in turn engage the inner pins and force the inner pins into the key slot. In the absence of a correct or proper key, the outer pins are partially disposed in the plug and block rotation of the plug within the housing.

The plug is rotatable relative to the housing in most conventional lock cylinders. A shear line is defined where the plug and the housing meet. When a proper key is inserted into the key slot, the inner pins are moved. Movement of the inner pins moves the respective outer pins so that the junctions of the inner pins and the outer pins are aligned with the shear line. This allows the plug to be turned to an unlocked position such that the outer pins are disposed completely in the housing, and the inner pins are disposed completely in the plug.

Some existing lock assemblies include an interchangeable core that has a housing and a plug that allow re-keying or replacement of the lock assembly. Interchangeable core lock assemblies permit re-keying of locks without opening the door or removing the lock from the door. Typically, existing housings and plugs are designed specifically for a particular lock type, and these interchangeable cores have mounting structure that is also designed specifically for the lock type in which the interchangeable core is used. Existing interchangeable cores are relatively complicated and are often manufactured using complex machining and manufacturing processes. For example, a knob lock assembly, a lever lock assembly, and deadbolt lock assembly each utilize a particular interchangeable core. These arrangements often complicate re-keying and/or replacement of the lock assembly.

Existing mortise lock assemblies include a one-piece housing that is inserted into an opening in a door or other structure, and that is engaged with a mortise chassis in the door to lock and unlock the door. These lock assemblies also include multiple anti-drill pins to limit tampering with the lock assembly, and a plug that is specifically sized for the mortise housing. To accommodate doors that have different thicknesses, existing mortise lock assemblies require multiple housings and plugs that are sized to conform to different door thicknesses. In particular, each housing and plug in existing mortise lock assemblies are designed to fit one door thickness, and cannot be used in lock assemblies that are applied to a door of a different thickness.

Some existing lock assemblies include a cam attached to the housing assembly and to a separate driver that is disposed in the housing assembly to move a latch between a locked position and an unlocked position. Often, a washer spaces the driver from the cam, and the cam is attached to the driver by a separate screw. Typically, the driver and the screw are inserted into the housing assembly through an opening in the front of the housing assembly. The cam is engaged with a rear of the housing assembly, and is attached to the driver using the screw.

During operation of the lock assemblies that include the cam, the driver is rotated by the plug, which in turn causes rotation of the cam to move the latch between the locked and unlocked positions. Often, the screw is loosened by operation of the lock assembly, which can disengage the cam from the driver. Disengagement of the cam from the driver can prevent the cam from moving the driver between the locked and unlocked positions. In some lock assemblies, a friction washer and/or a thread adhesive applied to the screw can be used to temporarily delay loosening of the cam from the housing assembly.

SUMMARY

The invention provides a method of manufacturing lock assemblies that enables a key-in-knob lock cylinder assembly to be used in different types of lock assemblies. For example, the method can include providing a key-in-knob lock assembly that has a key-in-knob housing and a plug that is rotatably engaged within the key-in-knob housing. The method also includes providing an interchangeable core ("IC") lock assembly that includes an IC housing, and inserting the key-in-knob housing into the IC housing such that the housing is universally exchangeable between the key-in-knob lock assembly and the IC lock assembly.

As another example, the method can include providing the key-in-knob lock assembly that has the key-in-knob housing and the plug, and providing a mortise lock assembly that includes a mortise housing, and inserting the key-in-knob housing into the mortise housing such that the housing is universally exchangeable between the key-in-knob lock assembly and the mortise lock assembly.

In yet another aspect, the invention provides a key-in-knob lock cylinder assembly and apparatus that enables use of at least portions of the lock cylinder assembly in different types of lock assemblies, e.g., interchangeable core and mortise lock assemblies. The method of manufacturing a lock assembly for enabling use of a key-in-knob lock cylinder assembly in different types of lock assemblies includes providing a key-in-knob lock assembly including a key-in-knob housing and a plug rotatably engaged within the key-in-knob housing, and providing at least one of a mortise lock assembly including a mortise housing and an interchangeable core lock assembly including an interchangeable core housing. The method also includes exchanging at least one of the key-in-knob housing and the plug between the key-in-knob lock assembly, the mortise lock assembly, and the interchangeable core lock assembly such that at least a portion of the key-in-knob lock assembly is universally exchangeable between the key-in-knob lock assembly, the mortise lock assembly, and the interchangeable core lock assembly.

In yet another aspect, the key-in-knob lock cylinder assembly includes a key-in-knob housing defining a cylindrical cavity, and an outer pin chamber communicating with the cavity that is adapted to house an outer pin. The key-in-knob lock assembly also includes a plug disposed in the cavity and rotatable within the cavity between a locked position and an unlocked position. The plug has an inner pin chamber that is aligned with the outer pin chamber when the plug is in the locked position. At least one of the key-in-knob housing and the plug is exchangeable between the key-in-knob lock assembly and at least one of an interchangeable core lock assembly and a mortise lock assembly In yet another aspect, the invention provides an IC lock assembly that includes an IC housing and an IC lock cylinder assembly. The IC housing includes a housing body defining cavity having a figure-eight cross section, and a locking hole that extends into the housing body from adjacent an upper portion of the cavity. The IC lock cylinder assembly includes a key-in-knob housing and a plug. The housing includes a wall that defines a hollow portion, and a pin portion that defines at least two outer pin chambers that receive outer pins. The plug includes a body that is rotatably housed within the hollow portion of the housing, a key slot that is disposed at least partially through the body, at least two inner pin chambers that are disposed within the body and in communication with the key slot that receive inner pins, and a pin receiving chamber that receives a control pin. The IC lock cylinder assembly also includes an actuating mechanism that is engageable by the control pin. The actuating mechanism includes an actuating pin holder, an actuating ring, an actuating pin that is engageable with the locking hole, and a connector pin. The actuating pin holder has a holder body, an insertion channel that extends partially through the holder body, and an insertion guide. The actuating pin holder is removably engaged with the pin portion via the insertion channel such that the actuating pin holder is removably secured to the key-in-knob housing.

In yet another aspect, the invention provides a mortise lock assembly for locking and unlocking a door having a driver mechanism that is movable between a locked position and an unlocked position. The mortise lock assembly includes a mortise housing, and a mortise lock cylinder assembly that has a key-in-knob housing and a plug that is rotatably engaged within the key-in-knob housing. The mortise housing includes a first housing portion that defines a first cavity, and a second housing portion that defines a second cavity and that is attached to the first housing portion. The key-in-knob housing and the plug are substantially disposed in the mortise housing within each of the first cavity and the second cavity. The mortise lock assembly also includes a cam that is engaged with an end of the plug and that includes a lobe that is engageable with the driver mechanism to move the driver mechanism between the locked position and the unlocked position.

In yet another aspect, the invention provides a lock assembly that includes an assembly housing defining a cavity, and a lock cylinder assembly that has a housing and a plug that is rotatably engaged within the housing. The housing and the plug are substantially disposed in the assembly housing within the cavity. The lock assembly also includes an extension that is engaged with an end of the plug, and a cam that is engaged with the extension such that the plug is operable with housings that have different lengths.

In yet another aspect, the invention provides a lock assembly that includes a housing, a lock cylinder assembly having a plug, a single-piece cam member, and a retainer clip. The cam member is attached to the housing via the retainer clip. The cam member includes a lobe and a drive element that is engaged with the plug to transfer rotation of the plug to the lobe. The retainer clip includes an arcuate portion that engages the cam member to resist rotation of the cam member when the lock cylinder assembly is removed from the housing.

In yet another aspect, the invention provides a lock assembly that includes a housing and a lock cylinder assembly having a plug, a single-piece cam member, and a retainer clip. The cam member is attached to the housing via the retainer clip. The cam member includes a lobe and a drive element that is engaged with the plug to transfer rotation of the plug to the lobe. The retainer clip has an extension and an arcuate portion that are engaged with the cam member to attach the cam member to the housing.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
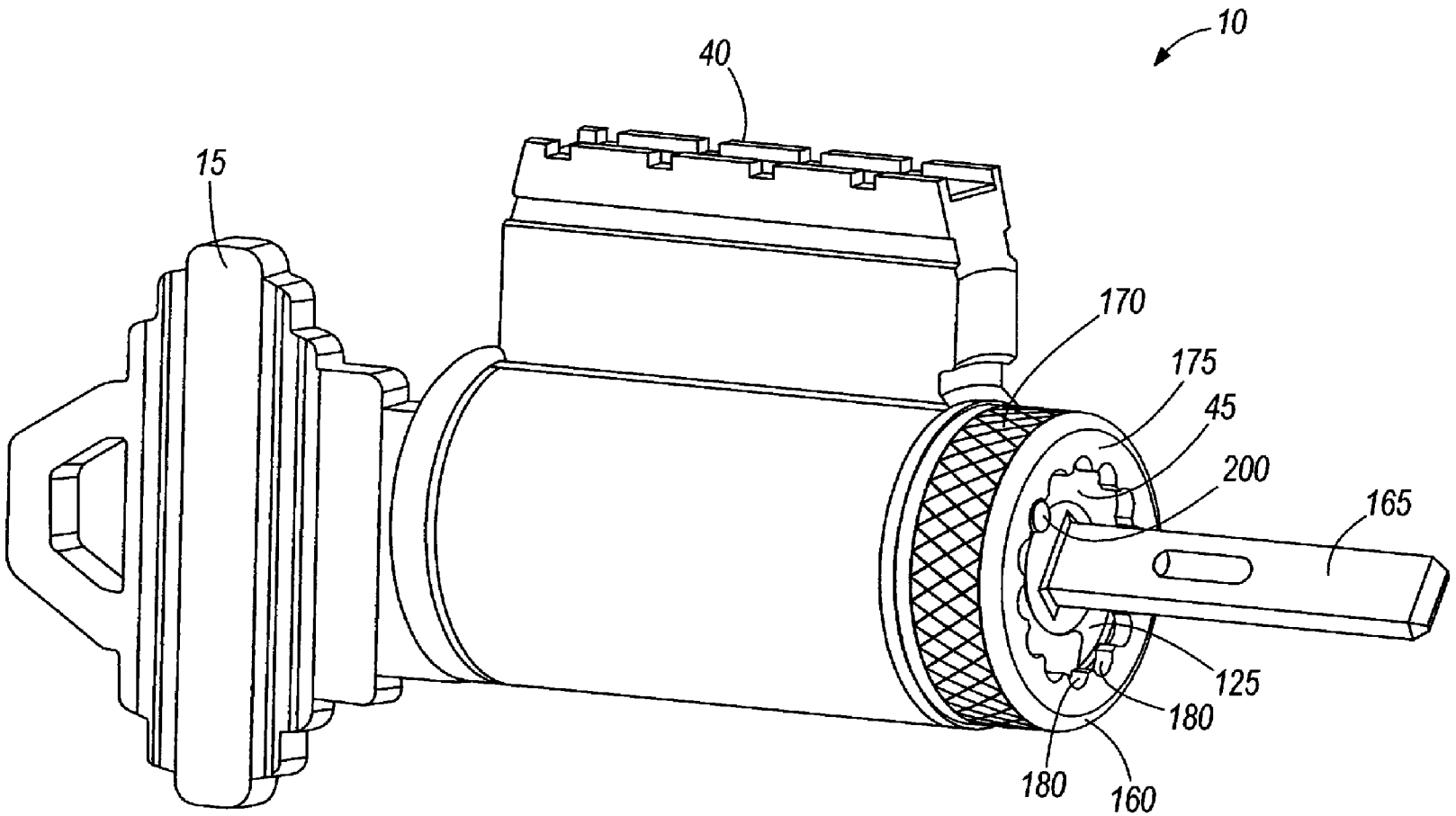
FIG. 1 is a perspective view of a lock assembly embodying the invention and including a housing, a plug, and an appropriate key.
Figure 3:
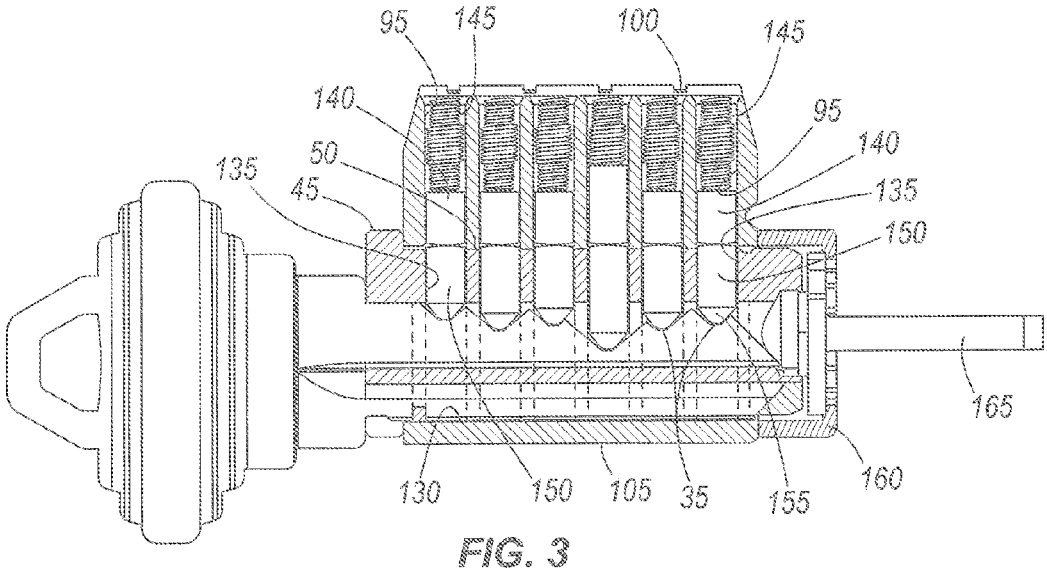
FIG. 3 is a section view of the lock assembly of FIG. 1 taken along line 3-3.
Figure 4:
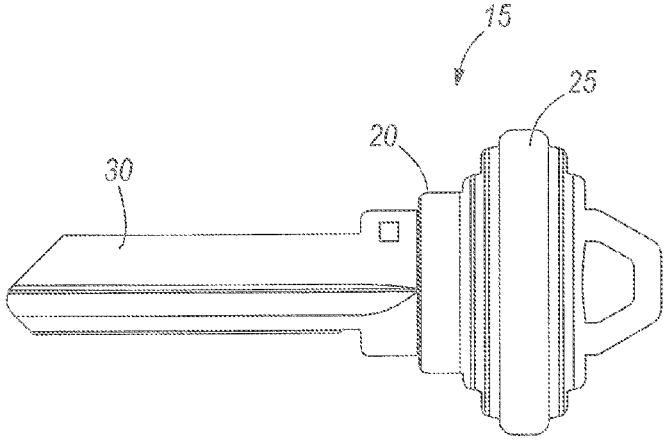
FIG. 4 is a side view of a key blank for the appropriate key of FIG. 1.

FIG. 1 shows a lock assembly 10 for use with structures (e.g., door, access panel, portable locks, etc.) that may be locked and unlocked. Hereinafter, the term "door" shall be used to represent all such lockable structures and shall not be construed to limit the invention's application solely to doors. The lock assembly 10 that is illustrated in FIG. 1 is a key-in-knob ("KIK") lock assembly that is lockable and unlockable using an appropriate key 15. As illustrated in FIG. 4, the key 15 is formed from a key blank 20 that includes a head portion 25 and a key portion 30. As illustrated in FIG. 3, the key portion 30 is shaped or cut to include pin engaging portions 35 that are formed along the length of the key portion 30.

Figure 2:
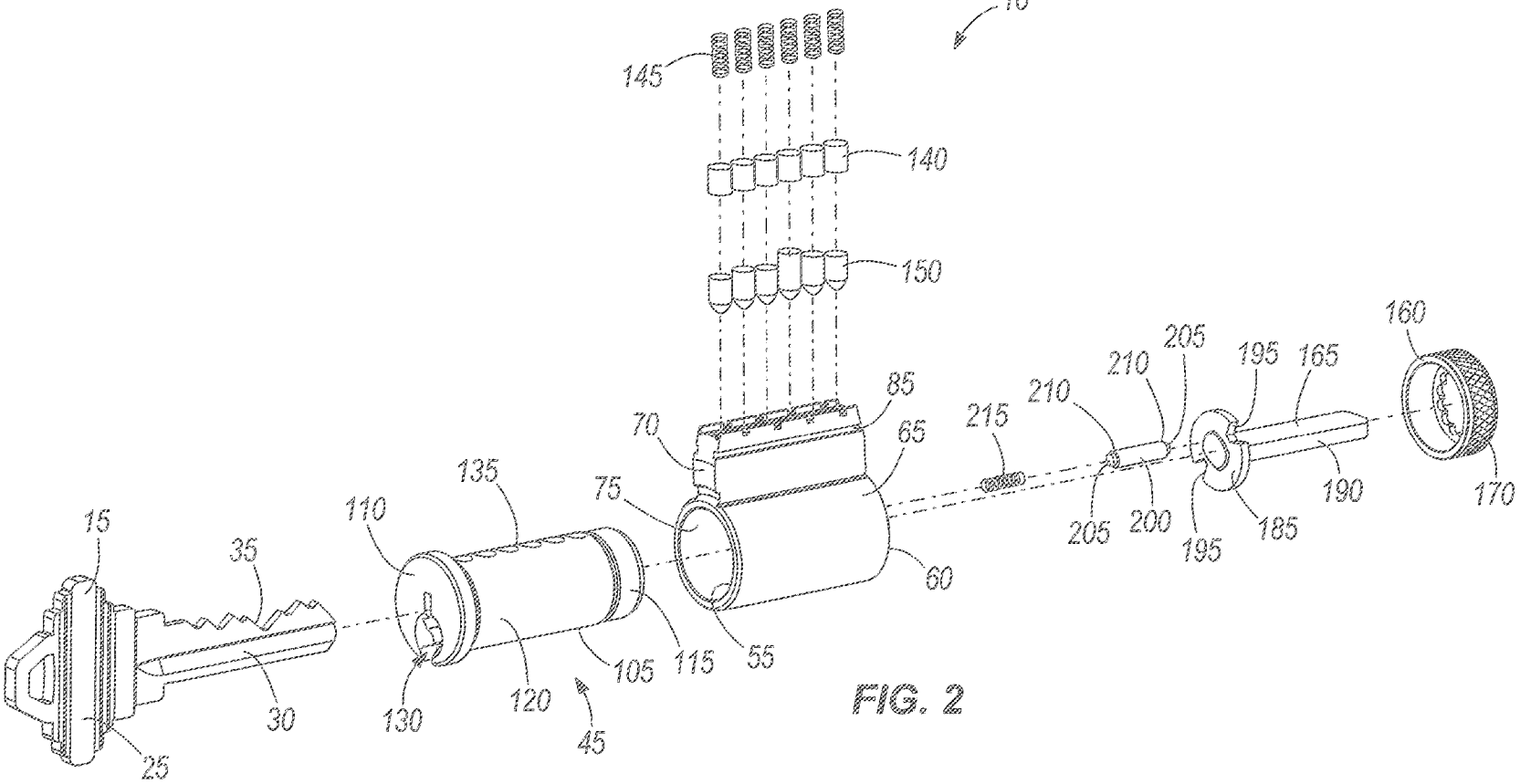
FIG. 2 is an exploded perspective view of the lock assembly of FIG. 1.
Figure 5:
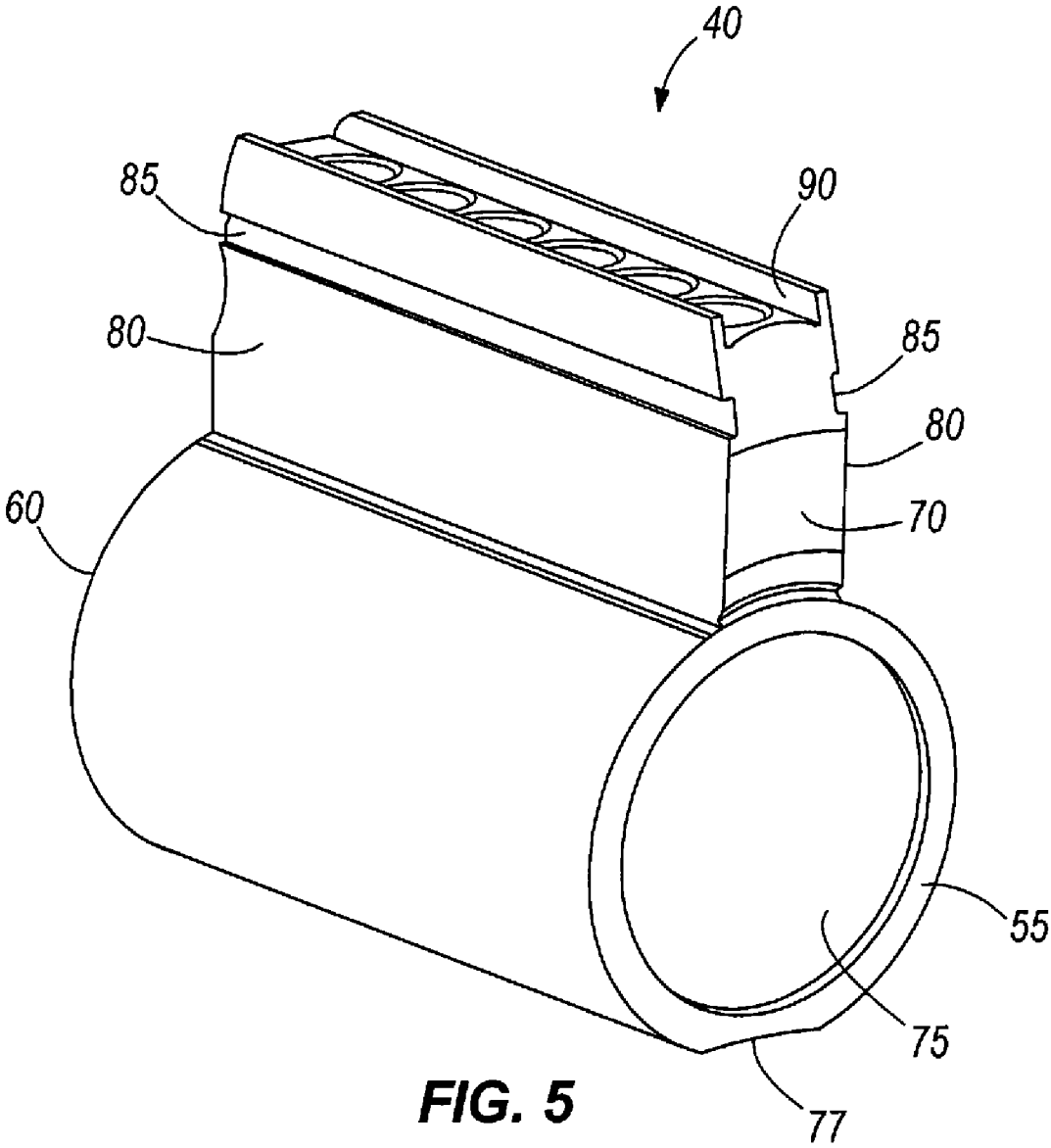
FIG. 5 is a perspective view of the housing of FIG. 1.

FIGS. 1 and 2 show that the KIK lock assembly 10 includes a housing 40 and a plug 45 that is selectively rotatable within the housing 40 using the appropriate key 15. As shown in FIG. 3, the housing 40 and the plug 45 cooperate with each other to define a shear line 50. FIGS. 2 and 5 show that the housing 40 includes a first end 55, a second end 60, a wall 65 and a pin portion 70. The wall 65 includes a substantially cylindrical portion that defines a hollow portion 75 that receives the plug 45. As illustrated in FIG. 5, the wall 65 also includes a substantially planar or flat outer surface 77 at a bottom of the housing 40 that extends from the first end 55 to the second end 60. In other constructions, the wall 65 may have a cylindrical shape without the flat outer surface 77. The housing 40 is typically fixed relative to the door, and the plug 45 is rotatable relative to the housing 40 within the hollow portion 75 between a locked position and an unlocked position.

As shown in FIGS. 2, 3, and 5, the pin portion 70 extends above the wall 65 and includes exterior surfaces 80, insertion slots 85, a pin cover channel 90, and first or outer pin chambers 95. The insertion slots 85 are disposed in the exterior surfaces 80, and extend along the length of the pin portion 70 between the first end 55 and the second end 60. In other constructions, the pin portion 70 may include insertion slots that extend from an outside end of the pin portion 70 toward the wall 65.

FIG. 3 shows that the outer pin chambers 95 are accessible through a cover strip 100 that is positioned adjacent the outer end of the pin portion 70 in the pin cover channel 90. As illustrated in FIG. 3, the outer pin chambers 95 extend inward into the pin portion 70 from adjacent the outer end of the pin portion 70. The pin portion 70 includes six outer pin chambers 95, but fewer or more outer pin chambers 95 are within the scope of the invention.

FIGS. 2 and 3 show that the plug 45 includes a body 105 that is rotatable relative to the housing 40 within the hollow portion 75. The body 105 is defined by a first end portion 110, a second end portion 115, and an outer surface 120. The first end portion 110 is accessible from the front of the KIK lock assembly 10. The second end portion 115 is accessible from the rear of the KIK lock assembly 10. FIG. 1 shows that the plug 45 includes two pin holes 125 (one shown) that extend into the plug 45 from the second end portion 115, and that are located diametrically opposite each other.

The plug 45 also includes a key slot 130 and second or inner pin chambers 135. The key slot 130 extends longitudinally through the body 105 from the first end portion 110 toward the second end portion 115, and is further accessible from adjacent the first end portion 110.

The inner pin chambers 135 extend from the outer surface 120 of the body 105 toward the key slot 130 substantially perpendicular to the key slot 130. The inner pin chambers 135 are in communication with the key slot 130, and are further selectively aligned with respective outer pin chambers 95 upon insertion of the plug 45 into the housing 40. FIG. 2 shows that the plug 45 includes six inner pin chambers 135. While the outer and inner pin chambers 95, 135 are shown as substantially cylindrical chambers, they can have other shapes (e.g., rectangular, etc.) that are within the scope of the invention.

FIGS. 2 and 3 show that the pin portion 70 further includes a respective first or outer pin 140 disposed within each of the outer pin chambers 95. The outer pins 140 are configured to move in a first or inward direction (downward in FIG. 3) into the plug 45, and in a second or outward direction (upward in FIG. 3) away from the plug 45. Generally, the outer pins 140 extend partially into the respective inner pin chambers 135 when the plug 45 is in the locked position and the appropriate key 15 is not inserted into the slot. The pin portion 70 further includes springs 145 to bias the outer pins 140 inward. In other constructions, the outer pins 140 may tend to move inward without the springs 145. In some constructions, the outer pins 140 can move inward without engagement by the springs 145 due to orientation of the pin portion 70 above the plug 45 (i.e., inward movement is assisted by gravity).

FIGS. 2 and 3 show that a respective second or inner pin 150 is disposed within each of the inner pin chambers 135. Each inner pin 150 can have a length that is the same as or different from the length of the other inner pins 150. Each of the inner pins 150 is selectively engaged with the respective outer pin, and the cover strip 100 is disposed in the pin cover channel 90 to retain the outer pins 140, the inner pins 150, and the springs 145 within the housing 40 and the plug 45. Each of the inner pins 150 includes an end portion 155 that extends into the key slot 130, and that is engageable by the key 15 after insertion of the key 15 into the key slot 130. Each end portion 155 of the inner pins 150 can be defined by a tapered cone, or alternatively, by other shapes (e.g., semispherical end, etc.).

Generally, the quantity of inner pins 150 will be the same as the quantity of outer pins 140. In the illustrated construction, the pin portion 70 includes six outer pins 140 and six inner pins 150. However more or fewer outer pins 140 and inner pins 150 may be possible and are within the scope of the invention. For example, commercial applications of the plug 45 usually include six outer and inner pins 140, 150, respectively, in accordance with established industry practices. However, residential applications of the plug 45 usually have settled on five outer and inner pins 140, 150, respectively. In these residential applications, the plug 45 may include five outer pins 140 and inner pins 150 in five corresponding outer and inner pin chambers 95, 135, even though the plug 45 may have six or more outer and inner pin chambers 95, 135. The remaining outer and inner pin chambers 95, 135 may be unused in residential applications. The invention described herein incorporates both commercial and residential applications of the lock assembly 10, and should not be limited to only one such application.

FIGS. 1-3 show that the KIK lock assembly 10 also includes a retainer or screw cap 160 and a driver bar or tailpiece 165. The screw cap 160 is attached to the second end portion 115 of the plug 45 to rotatably couple the tailpiece 165 to the plug 45 so that a latch (not shown) can be moved relative to the door by a driver mechanism (not shown) to lock or unlock the door. More particularly, the screw cap 160 includes a cylindrical wall 170 that is inwardly threaded to threadably engage the body 105 adjacent the second end portion 115. As shown in FIG. 1, the screw cap 160 also includes a circumferential end wall 175 that extends radially inward along the cylindrical wall 170. The end wall 175 has a plurality of grooves or arcuate recesses 180 that are equally spaced circumferentially along the inner portion of the end wall 175.

The tailpiece 165 is attached to the plug 45 via the screw cap 160, and extends into the door. The tailpiece 165 includes a pin engagement portion 185 and a bar 190. The pin engagement portion 185 includes two pin slots 195 that are located diametrically opposite each other, and that are generally aligned with at least one of the pin holes 125 when the tailpiece 165 is attached to the plug 45. The bar 190 is coupled to the pin engagement portion 185, and engages the driver mechanism to move the latch between the locked position and the unlocked position.

An alignment pin 200 is disposed in one of the pin holes 125 to align the plug 45 and the tailpiece 165. The alignment pin 200 is an elongated member that includes tapered or reduced-diameter ends 205 that define shoulders 210 of the alignment pin 200. A spring 215 is disposed in the pin hole 125 in which the alignment pin 200 is disposed to bias the alignment pin 200 toward the second end portion 115 of the plug 45. One shoulder 210 of the alignment pin 200 is engaged by the spring 215, and the other shoulder 210 is engaged with the end wall 175 of the screw cap 160. The alignment pin 200 is also engaged with one of the plurality of arcuate recesses 180 of the screw cap 160 to secure the screw cap 160 to the plug 45, and to align the plug 45, the screw cap 160, and the tailpiece 165 relative to each other. The alignment pin 200 also transfers rotation of the plug 45 to the tailpiece 165 so that the door can be locked and unlocked.

In operation of the KIK lock assembly 10, the springs 145 bias the outer pins 140 and the inner pins 150 inward such that the outer pins 140 partially extend into the inner pin chambers 135 without the appropriate key 15 in the key slot 130. Generally, the inner pins 150 are in communication with the key slot 130 for selective engagement by a key (e.g., the key 15) that is inserted into the key slot 130. When the appropriate key 15 is inserted into the key slot 130, the pin engaging portions 35 engage the inner pins 150 to move the outer pins 140 to the shear line 50. The plug 45 is rotated to lock or unlock the door after the outer pins 140 are aligned with the shear line 50, which rotates the screw cap 160 and the tailpiece 165 to move the latch between the locked and unlocked positions.

FIGS. 6-23 show another construction of a lock assembly 310 for use with the door. Except as described below, the lock assembly 310 is similar to the lock assembly 10 described with regard to FIGS. 1-5, and common elements are given the same reference numerals. The lock assembly 310 that is illustrated in FIGS. 6-23 is an interchangeable core ("IC") lock assembly that is lockable and unlockable using an appropriate key 315 (FIG. 11) that is similar to the key 15.

Figure 6:
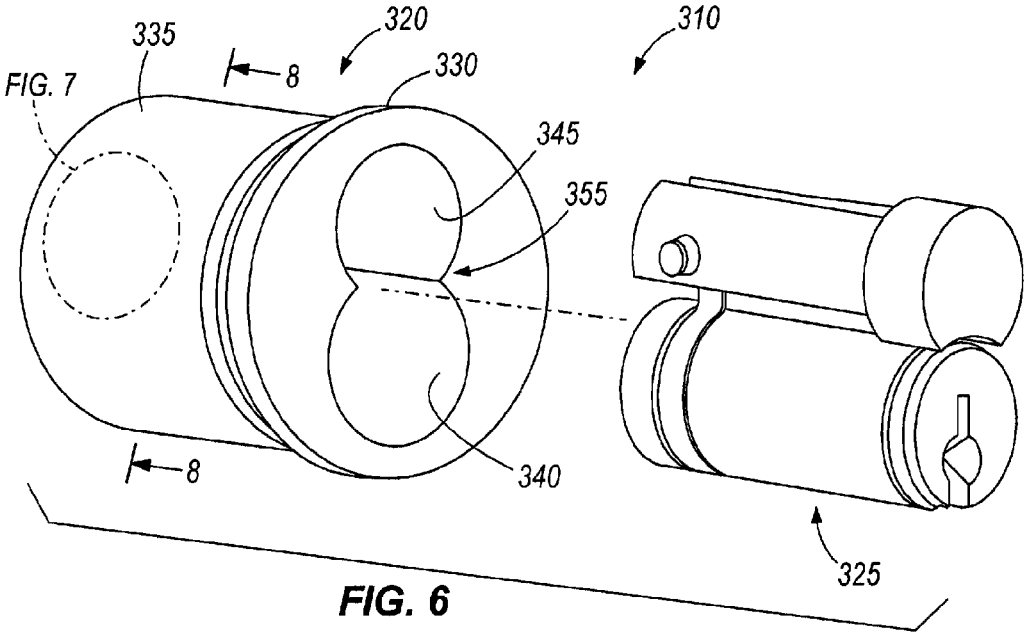
FIG. 6 is a perspective view of another lock assembly embodying the invention and including an interchangeable core housing and an interchangeable core lock cylinder assembly.
Figure 7:
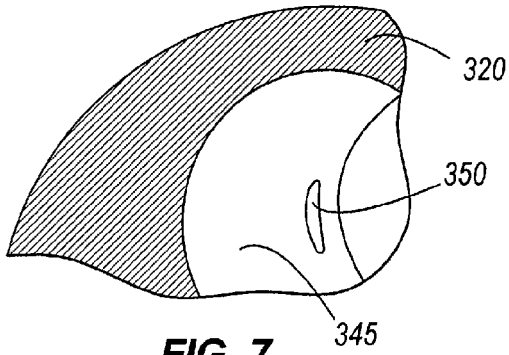
FIG. 7 is a perspective view of a portion of the interchangeable core housing of FIG. 6.
Figure 9:
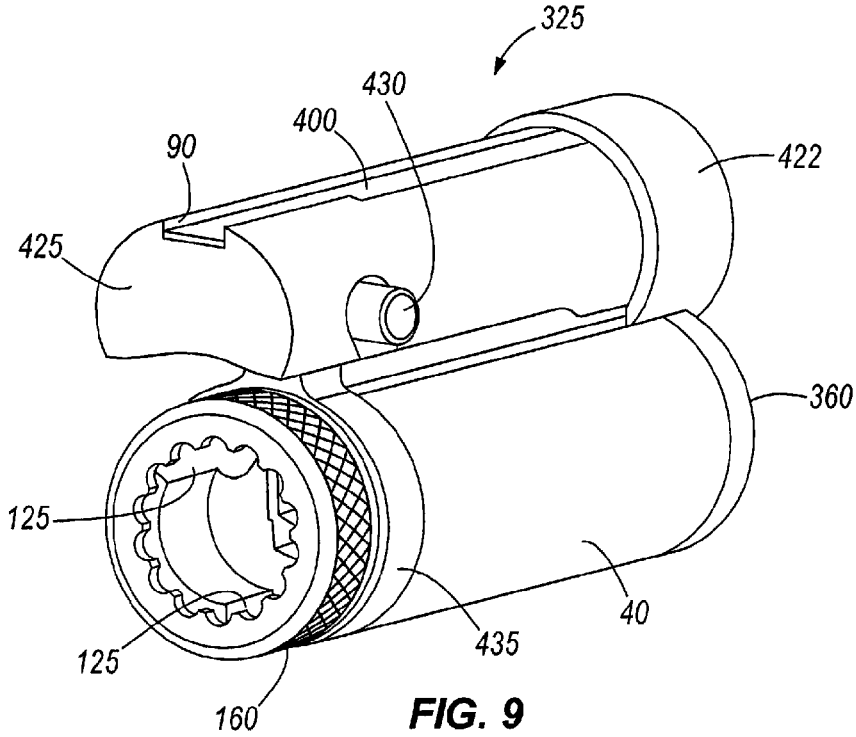
FIG. 9 is a perspective view of the interchangeable core lock cylinder assembly.
Figure 10:
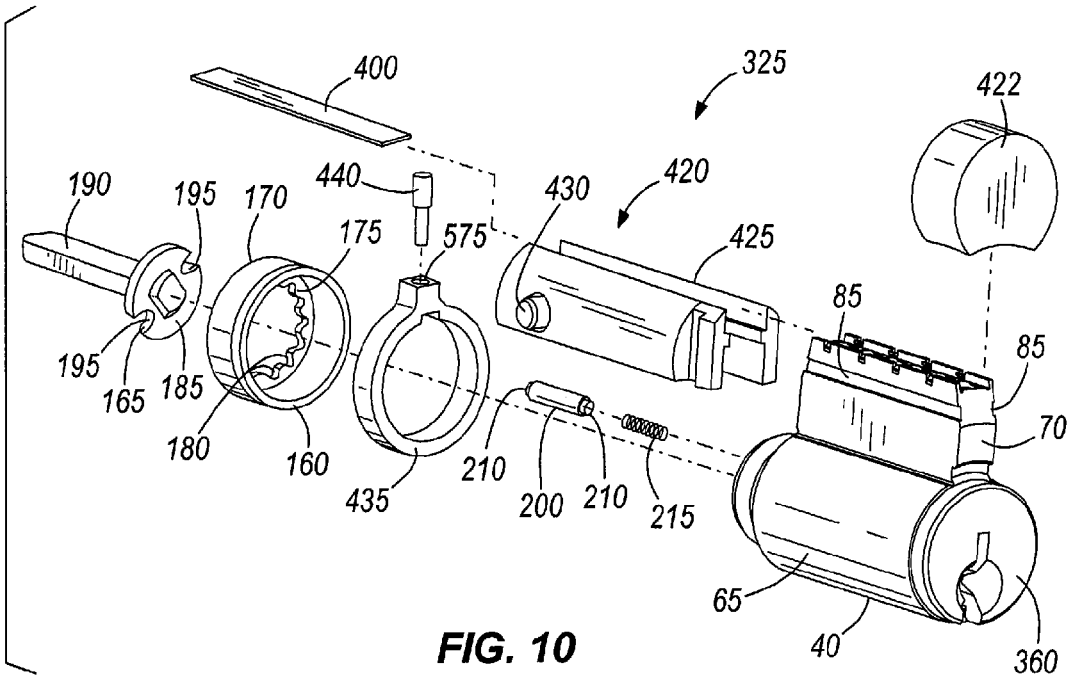
FIG. 10 is an exploded perspective view of the interchangeable core lock cylinder assembly of FIG. 6 that includes a housing, a plug, an actuating mechanism, and a face plate.

As illustrated in FIGS. 6, 9, and 10, the lock assembly 310 includes an IC housing 320 and an IC lock cylinder assembly 325. FIG. 6 shows that the IC housing 320 includes a rim 330 and a housing body 335 that extends from the rim 330. The rim 330 abuts a surface of the door, and the housing body 335 engages the inside of the door.

Figure 8:
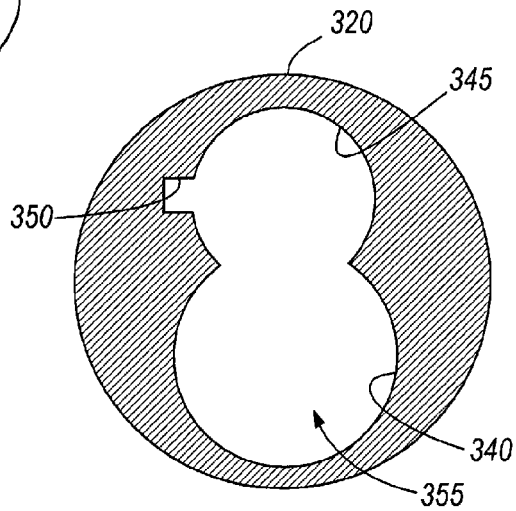
FIG. 8 is a section view of the interchangeable core housing of FIG. 6 taken along line 8-8.

FIGS. 6 and 8 show that the IC housing 320 also includes a first interior surface 340, a second interior surface 345, and a locking hole 350. The first interior surface 340 and the second interior surface 345 cooperate with each other and intersect to define a cavity 355 that has a substantially "figure-eight" shaped cross-section. As illustrated in FIG. 8, each of the first interior surface 340 and the second interior surface 345 is generally cylindrical, and the cavity 355 extends completely through the IC housing 320. As viewed in FIG. 8, the first interior surface 340 is disposed generally below the second interior surface 345.

The locking hole 350 extends into the IC housing 320 from the second interior surface 345 adjacent the end of the housing body 335 that is opposite the rim 330. The locking hole 350 is generally cylindrically-shaped, although other shapes of the locking hole 350 are considered herein.

Figure 11:
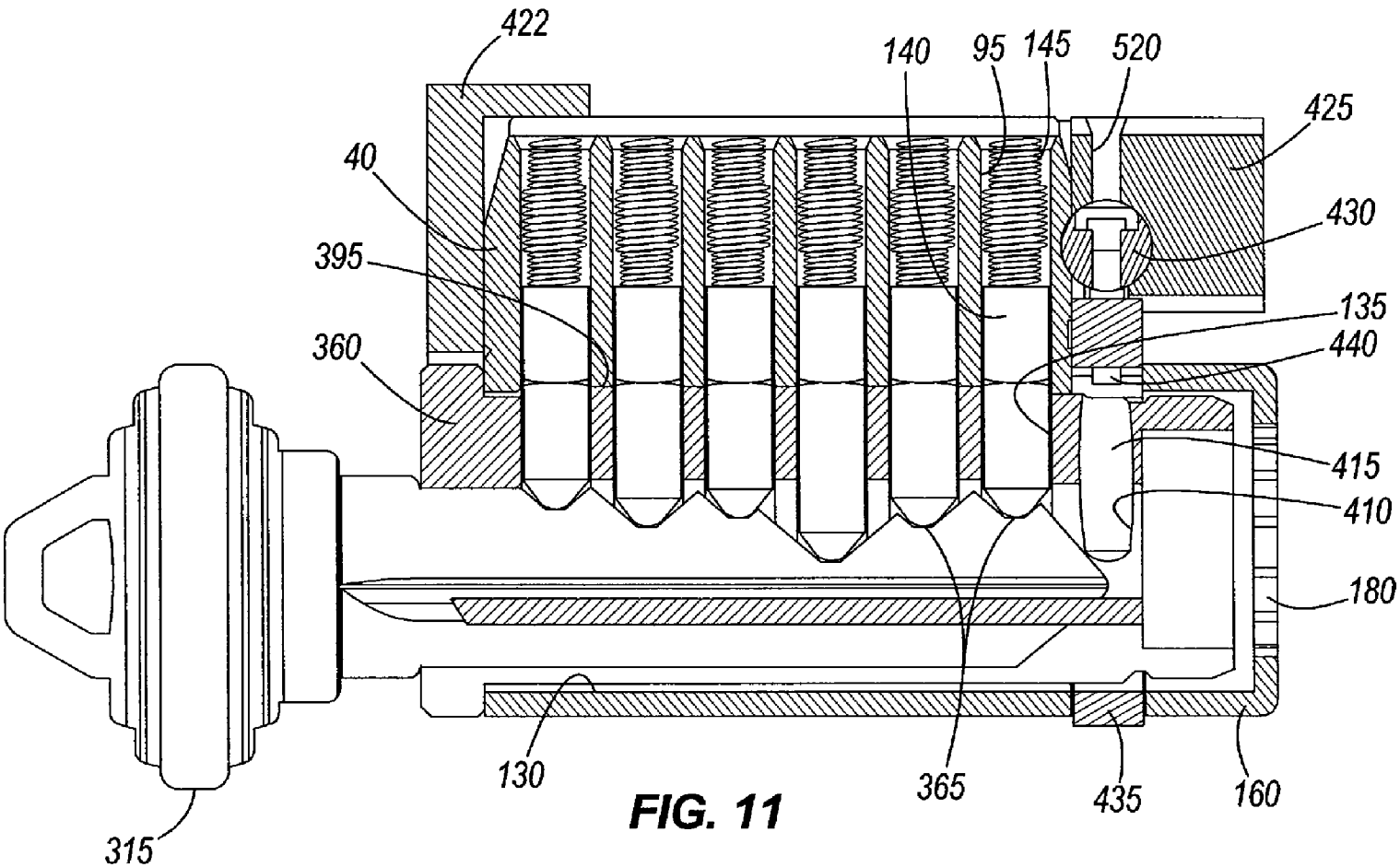
FIG. 11 is a section view of the interchangeable core lock cylinder assembly of FIG. 9 including a control key inserted into the plug.

The IC lock cylinder assembly 325 is insertable into the IC housing 320 within the cavity 355, and is generally held in place by the first and second interior surfaces 340, 345. FIGS. 9-11 show that the lock cylinder assembly 325 includes the housing 40 and a plug 360 that is selectively rotatable within the housing 40. Upon insertion of the IC lock cylinder assembly 325 into the IC housing 320, the housing 40 is fixed relative to the IC housing 320 and the door, and the plug 360 is movable relative to the housing 40 between a locked position and an unlocked position using the key 315 that has pin engaging portions 365. The wall 65 of the housing 40 is substantially engageable with the first interior surface 340 when the IC lock cylinder assembly 325 is disposed in the cavity 355.

Figure 12:
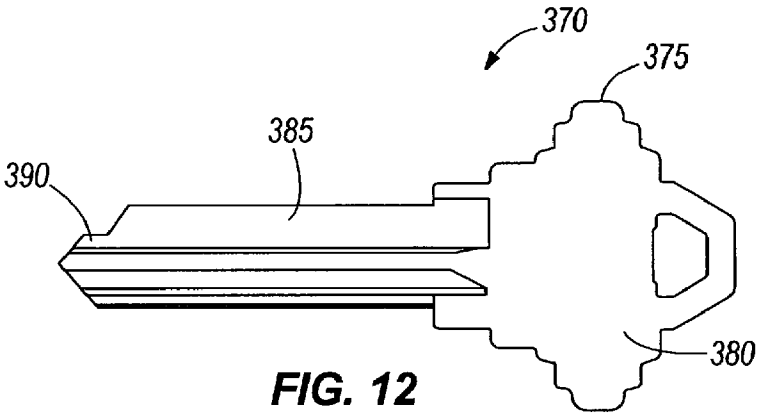
FIG. 12 is a side view of a key blank for the control key of FIG. 11.

A control key 370 is used to lock and unlock the IC lock cylinder assembly 325 relative to the IC housing 320. FIG. 12 shows that the control key 370 is formed from a key blank 375 that includes a head portion 380 and a key portion 385. Generally, the key portion 385 of the control key 370 is shaped or cut to include the pin engaging portions 365. The control key 370 is further shaped to include a projection 390 on the end of the key portion 385.

As shown in FIG. 11, the housing 40 and the plug 360 cooperate with each other to define a shear line 395. The outer pin chambers 95 are accessible through a cover strip 400 that is positioned in the pin cover channel 90 adjacent the outer end of the pin portion 70.

Figure 14:
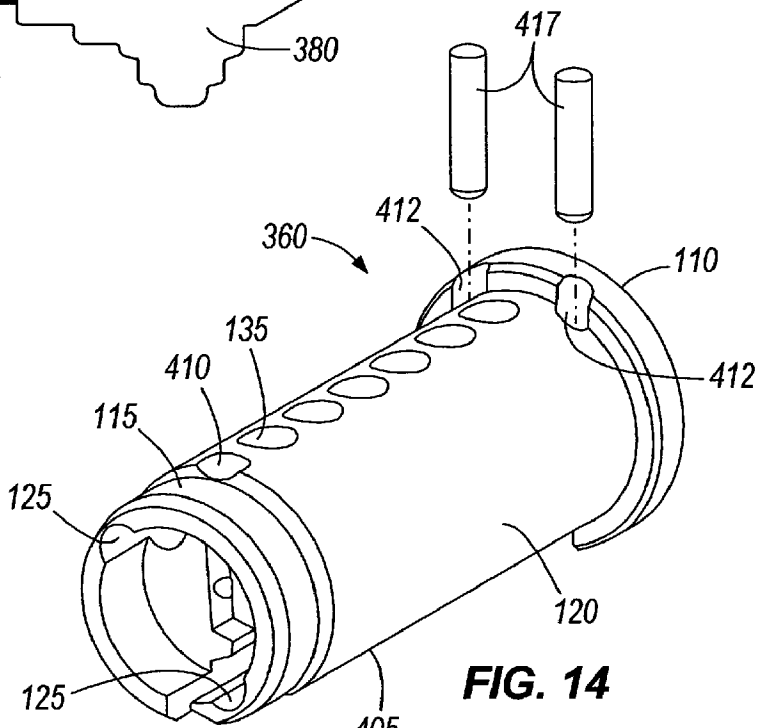
FIG. 14 is another perspective view of the plug of the anti-tamper pins.
Figure 13:
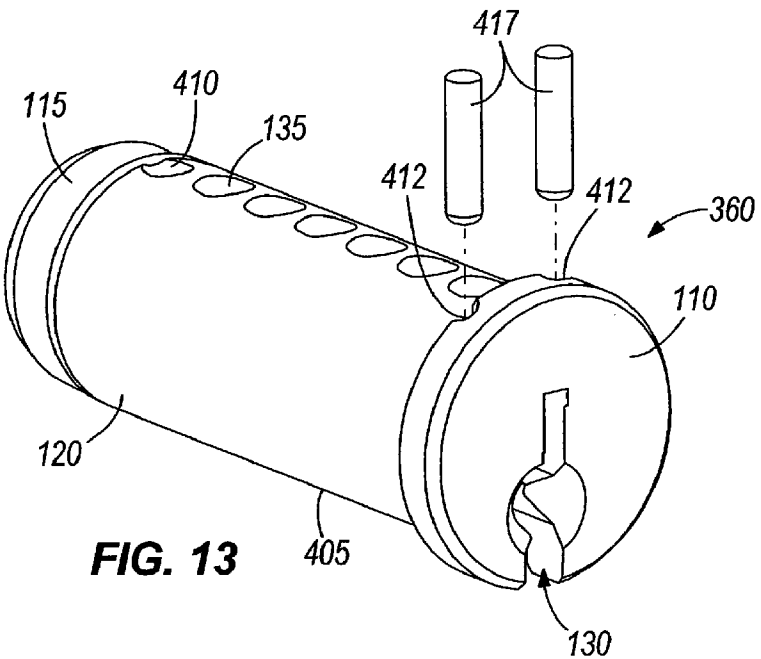
FIG. 13 is a perspective view of the plug of FIG. 9 and anti-tamper pins exploded from the plug.

Except as described below, the plug 360 is similar to the plug 45 that is described with regard to FIGS. 1-5, and common elements are given the same reference numerals. FIGS. 13 and 14 show that the plug 360 includes a body 405 that is rotatable relative to the hollow portion 75 of the housing 40. The body 405 is defined by the first end portion 110, the second end portion 115, and the outer surface 120.

FIGS. 9 and 14 show that the plug 360 also includes the pin holes 125, the key slot 130, the inner pin chambers 135, a pin receiving chamber 410, and anti-tamper holes 412. Generally, the inner pin chambers 135 are longitudinally aligned with each other between the first end portion 110 and the second end portion 115, and the inner pins 150 are disposed within each of the inner pin chambers 135. The cover strip 400 is disposed in the pin cover channel 90 to retain the outer and inner pins 140, 150 and the springs 145 within the housing 40 and the plug 360.

The pin receiving chamber 410 is proximate to the second end portion 115, and is offset from the inner pin chambers 135 such that the pin receiving chamber 410 is not longitudinally aligned with the inner pin chambers 135 along the outer surface 120. The pin receiving chamber 410 is in communication with the key slot 130. FIGS. 11 and 21-23 show that a control pin 415 is disposed in the pin receiving chamber 410. The control pin 415 can have a length that is the same as or different from the length of the inner pins 150. The control pin 415 extends into the key slot 130, and is engageable by the projection 390 of the control key 370 after insertion of the control key 370 into the key slot 130. The end of the control pin 415 can be defined by a tapered cone, or alternatively, by other shapes (e.g., semispherical end, etc.).

FIGS. 13 and 14 show that the anti-tamper holes 412 are disposed in the plug 360 adjacent the first end portion 110 on opposite sides of the key slot 130. The anti-tamper holes 412 receive anti-tamper pins 417, which are resistant to drilling or other tampering methods and cooperate with the plug 360 to inhibit removal of the plug from the IC lock assembly 310.

FIG. 10 shows that the IC lock cylinder assembly 325 also includes the screw cap 160, the tailpiece 165, the alignment pin 200, the spring 215, an actuating mechanism 420, and a face plate 422. The actuating mechanism 420 is coupled to the housing 40 and the plug 360, and is movable between a locked position and an unlocked position using the control key 370. When the actuating mechanism 420 is in the locked position, the IC lock cylinder assembly 325 is locked into the IC housing 320 so that the IC lock cylinder assembly 325 cannot be removed from the IC housing 320 without the control key 370. When the actuating mechanism 420 is in the unlocked position, the IC lock cylinder assembly 325 is removable from the IC housing 320.

Figure 15:
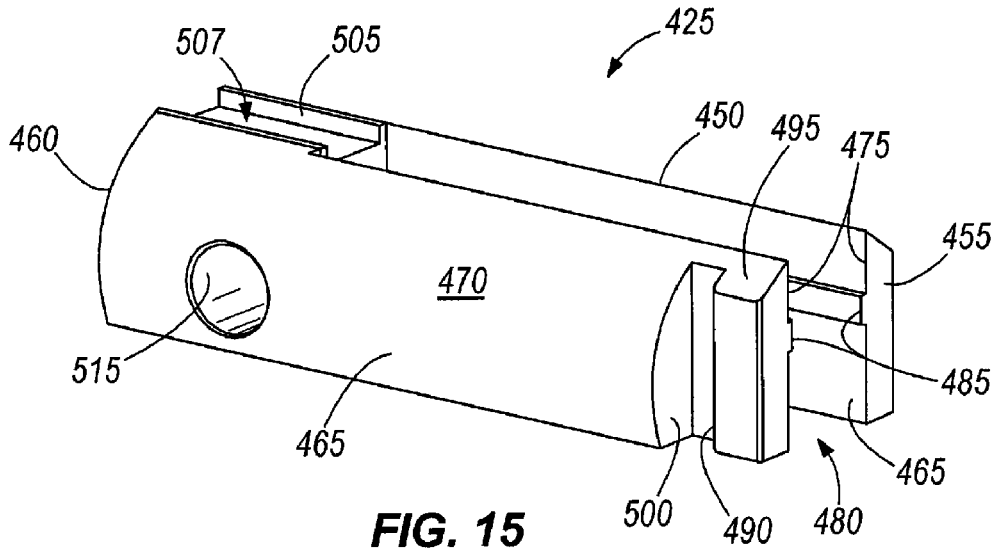
FIG. 15 is a perspective view of an actuating pin holder of the actuating mechanism of FIG. 9.
Figure 16:
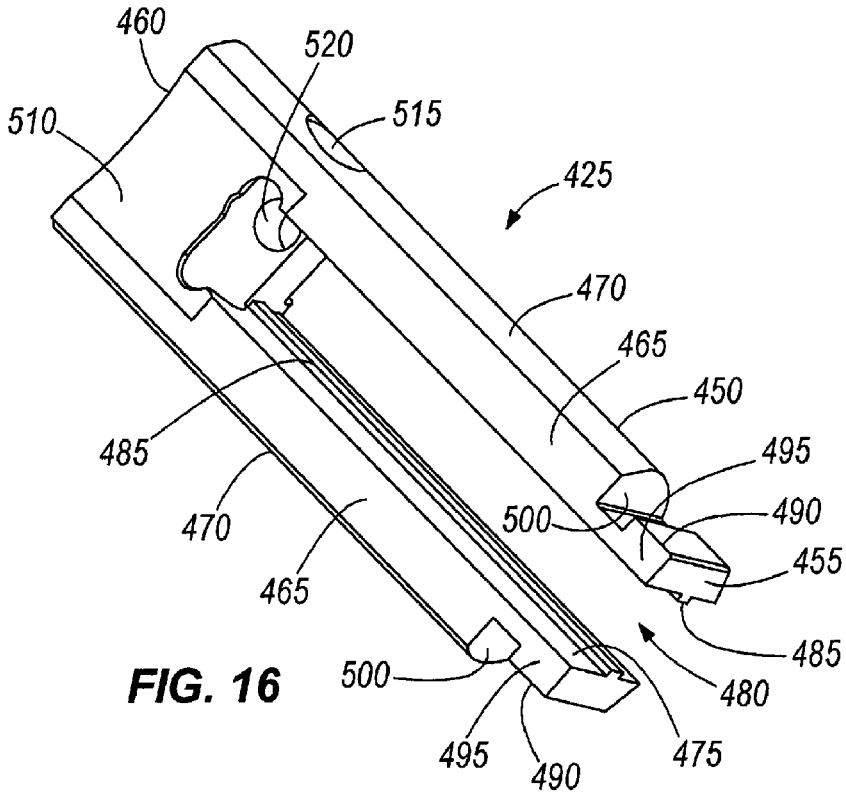
FIG. 16 is another perspective view of the actuating pin holder.
Figure 17:
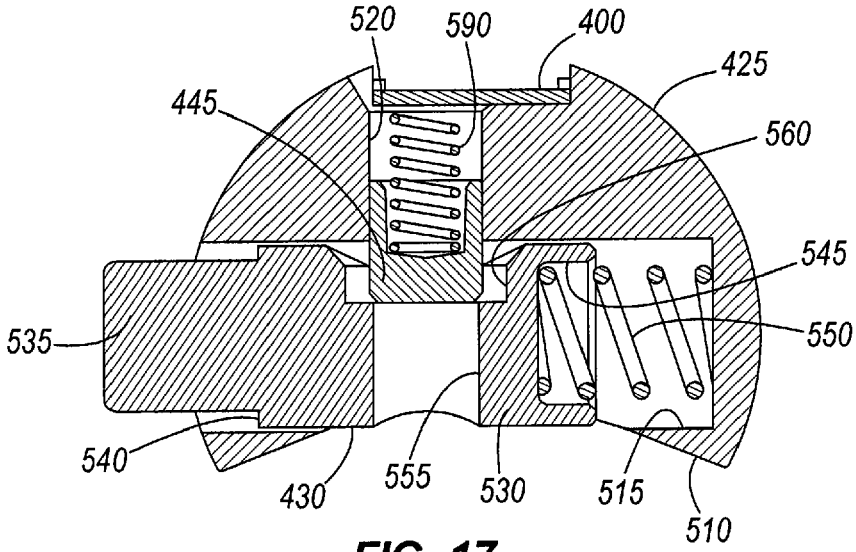
FIG. 17 is a section view of a portion of the actuating mechanism that includes an actuating pin and a locking pin.

FIGS. 10 and 17 show that the actuating mechanism 420 includes an actuating pin holder 425, an actuating pin 430, an actuating ring 435, a connector pin 440, and a stop pin 445. FIGS. 15 and 16 show that the actuating pin holder 425 includes a holder body 450 that has a first or insertion end 455, a second or actuating end 460, and two insertion arms 465 that are attached to each other adjacent the actuating end 460. The insertion arms 465 extend from the actuating end 460 toward the insertion end 455 substantially parallel to each other.

The insertion arms 465 are spaced apart from each other and include exterior surfaces 470 and interior surfaces 475. The exterior surfaces 470 extend between the insertion end 455 and the actuating end 460, and substantially engage a portion of the second interior surface 345 of the IC housing 320 when the lock cylinder assembly 325 is inserted into the cavity 355. The interior surfaces 475 define an insertion channel 480 that extends partially longitudinally through the holder body 450, and that is accessible from adjacent the insertion end 455. The insertion channel 480 is substantially enclosed at one end by the actuating end 460. The pin portion 70 is disposed in the insertion channel 480 when the lock cylinder assembly 325 is assembled such that the outer pin chambers 95 are accessible through the actuating pin holder 425.

Each insertion arm 465 also includes an insertion rail 485 and an insertion guide 490. The insertion rail 485 protrudes from the interior surface 475 into the insertion channel 480, and extends along the length of the insertion channel 480. The actuating pin holder 425 is attachable to the housing 40 by engaging each insertion rail 485 with the respective insertion slot 85 on the pin portion 70.

The insertion guides 490 are formed on the ends each of the insertion arms 465 adjacent the insertion end 455. Each insertion guide 490 includes a rib or protrusion 495 that cooperates with a portion of the holder body 450 to define a guide recess 500. In the illustrated construction, the protrusion 495 has substantially flat surfaces. In other constructions, the protrusion 495 can include curved or rounded surfaces. In still other constructions, the protrusion 495 may include one or more slanted surfaces. Similarly, in some constructions, the guide recess 500 can be defined by substantially flat surfaces. In other constructions, the guide recess 500 can be defined by one or more curved or rounded surfaces. In still other constructions, the guide recess 500 may be defined by one or more slanted surfaces.

FIGS. 15 and 16 show that the actuating end 460 connects the insertion arms 465 to each other to form the unitary actuating pin holder 425. The actuating end 460 includes an upper portion that has a shallow groove or channel 505 that is defined by a surface 507 and that receives a portion of the cover strip 400, and a lower portion that is defined by a substantially cylindrical surface 510. As illustrated in FIG. 8, the shallow channel 505 is defined by a substantially flat surface 507. The cover strip 400 is coupled to the actuating end 460 and to the outer end of the pin portion 70 in the pin cover channel 90 to retain the outer pins 140, the inner pins 150, and the springs 145 in the housing 40 and the plug 360.

The actuating pin holder 425 also includes a first bore or passageway 515 and a second bore or passageway 520. FIGS. 15-17 show that the first passageway 515 has a cylindrical shape, and extends into the pin holder body 450 adjacent the actuating end 460 from one of the exterior surfaces 470 partially through the actuating pin holder 425 toward the other exterior surface 470. The first passageway 515 is oriented substantially perpendicular to the insertion channel 480, and receives the actuating pin 430. FIGS. 16 and 17 show that the first passageway 515 is in communication with the lower portion of the actuating end 460 such that a portion of the first passageway is exposed. In the illustrated construction, the first passageway 515 is substantially horizontal when the IC lock assembly 310 is inserted into the door.

FIGS. 16 and 17 show that the second passageway 520 is offset from a longitudinal center of the actuating pin holder 425, and extends through the holder body 450 from the surface 507 that defines the shallow channel 505 to the cylindrical surface 510. The second passageway 520 is oriented substantially perpendicular to the first passageway 515 such that the second passageway 520 intersects the first passageway 515. In the illustrated construction, the second passageway 520 is oriented substantially when the IC lock assembly 310 is inserted into the door.

Figure 18:
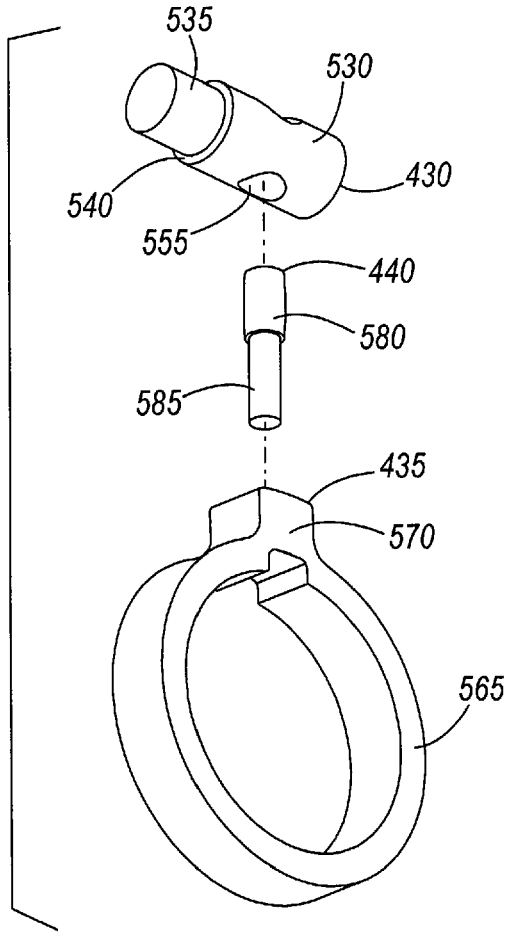
FIG. 18 is a perspective view of a portion of the actuating mechanism that includes an actuating pin, an actuating ring, and a connector pin.

FIG. 18 shows the actuating pin 430, the actuating ring 435, and the connector pin 440 prior to assembly. FIG. 17 shows that the actuating pin 430 is disposed in the first passageway 515. In the illustrated construction, the actuating pin 430 is substantially cylindrically-shaped to conform to the shape of the first passageway 515. Other shapes of the actuating pin 430 are also possible and considered herein. Generally, the cylindrical shape of the actuating pin 430 ensures surface contact between the actuating pin holder 425 and the actuating pin 430 to minimize stress on the actuating pin holder 425 and the actuating pin 430.

The actuating pin 430 includes a first body portion 530 that has a first diameter, and a second body portion 535 that has a second diameter that is smaller than the first diameter, defining a transition or shoulder 540. Generally, the actuating pin 430 is movable within the first passageway 515 between an engaged position that engages the second body portion 535 with the locking hole 350, and a disengaged position that disengages the second body portion 535 from the locking hole 350. The illustrated second body portion 535 is smaller than the first body portion 530 to avoid interference between the second body portion 535 and the portion of the second interior surface 345 that is adjacent the locking hole 350 when the actuating pin 430 is moved to the engaged position. In other constructions, the second diameter of the second body portion 535 can be the same as the first diameter of the first body portion 530, without the shoulder 540.

FIG. 17 shows that the first body portion 530 includes a spring recess 545. A spring 550 is disposed in the first passageway 515. One end of the spring 550 is engaged with the interior end of the first passageway 515 of the actuating pin holder 425, and the other end of the spring is engaged with the actuating pin 430 within the spring recess 545 to bias the actuating pin 430 to the engaged position.

FIGS. 17 and 18 show that the actuating pin 430 also includes a bore 555 that extends completely through the first body portion 530 proximate to the middle of the first body portion 530. An upper portion of the bore 555 defines an engagement recess 560 that receives the stop pin 445. The actuating pin 430 is insertable into the first passageway 515 and slidable within the first passageway 515 between the disengaged position and the engaged position such that the bore 555 is substantially aligned with the second passageway 520 when the actuating mechanism 420 is in the engaged position.

FIGS. 9 and 21-23 show that the actuating ring 435 is coupled to the housing 40 and the plug 360. The actuating ring 435 is rotatable or pivotable relative to the housing 40 via rotation of the plug 360. In the illustrated construction, the angle of rotation of the actuating ring 435 relative to the housing 40 is approximately 12 degrees. In other constructions, the angle of rotation of the actuating ring 435 relative to the housing 40 can be more or less than 12 degrees.

FIG. 18 shows that the actuating ring 435 includes a ring body portion 565 and a pin receiving portion 570. The ring body portion 565 and the pin receiving portion 570 define a transition that receives the upper end of the control pin 415 after the control pin 415 is engaged by the control key 370. The ring body portion 565 has a substantially hollow cylindrical shape to receive the second end portion 115 of the plug 360, and is at least partially held onto the lock cylinder assembly 325 by the screw cap 160.

Figure 22:
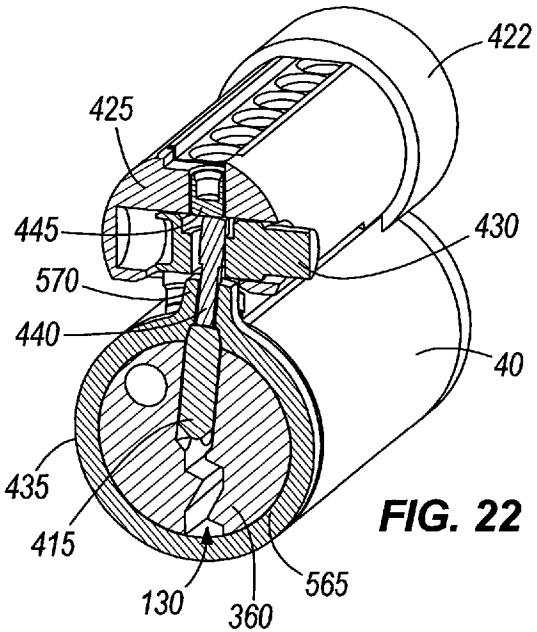
FIG. 22 is a perspective view of a portion of the interchangeable core lock cylinder assembly with the control key inserted into the plug.
Figure 23:
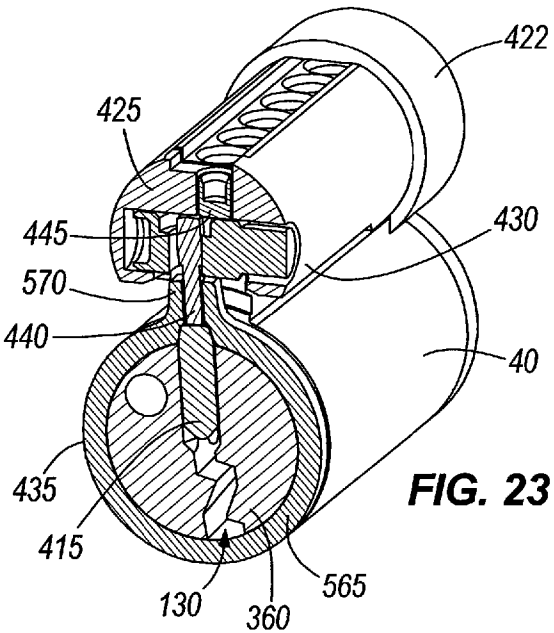
FIG. 23 is another perspective view of a portion of the interchangeable core lock cylinder assembly with the control key inserted into the plug.
Figure 21:
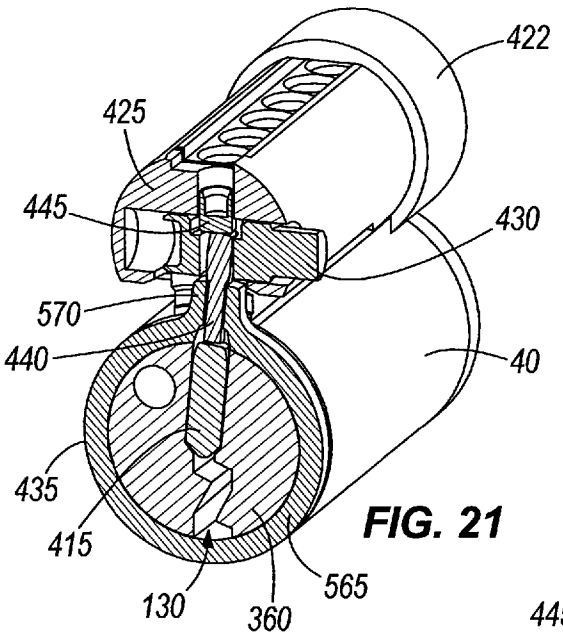
FIG. 21 is a perspective view of a portion of the interchangeable core lock cylinder assembly.

The pin receiving portion 570 is coupled to the ring body portion 565 at an apex of the actuating ring 435, and is engaged with the cylindrical surface 510. FIGS. 21-23 show that the pin receiving portion 570 is in communication with the actuating pin 430. FIG. 10 shows that the pin receiving portion 570 includes a pin bore 575 that extends completely through the pin receiving portion 570. When the actuating mechanism 420 is assembled, the pin receiving portion 570 is engaged with the actuating pin holder 425, and is pivotable along the cylindrical surface 510.

The connector pin 440 is disposed in the pin bore 575 of the actuating ring 435 to engage the actuating pin 430 to selectively move the actuating pin 430 between the engaged position and the disengaged position. FIG. 18 shows that the connector pin 440 includes a pin head portion 580 that has a first diameter, and an elongated portion 585 that is coupled to the pin head portion 580 and that has a second diameter that is smaller than the first diameter. The elongated portion 585 is disposed in the pin bore 575 of the pin receiving portion 570. As illustrated in FIGS. 21-23, the pin head portion 580 extends upward from the elongated portion 585 into the bore 555 of the actuating pin 430. The connector pin 440 is engageable by the control pin 415 to move the connector pin 440 between a first position in which the pin head portion 580 is substantially engaged with the pin receiving portion 570, and a second position in which the pin head portion 580 is spaced a relatively small distance from the pin head portion 580.

FIGS. 11, 17, and 21-23 show that the stop pin 445 and a spring 590 are disposed in the second passageway 520 of the actuating pin holder 425. The stop pin 445 is engageable with the engagement recess 560 of the actuating pin 430 to limit movement of the actuating pin 430 between the disengaged position and the engaged position. The stop pin 445 is substantially cylindrical, and includes a spring recess portion 595 that receives an end of the spring 590. The spring 590 is engaged with the cover strip 400 and with the stop pin 445 within the spring recess portion 595 to bias the stop pin 445 toward the actuating pin 430 and the engagement recess 560.

Figure 20:
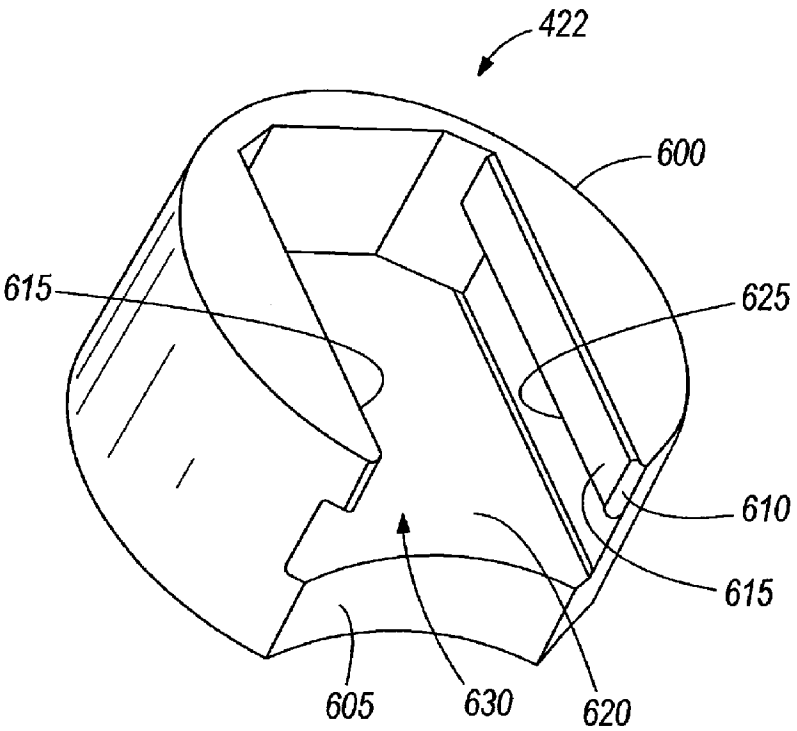
FIG. 20 is another perspective view of the face plate.
Figure 19:
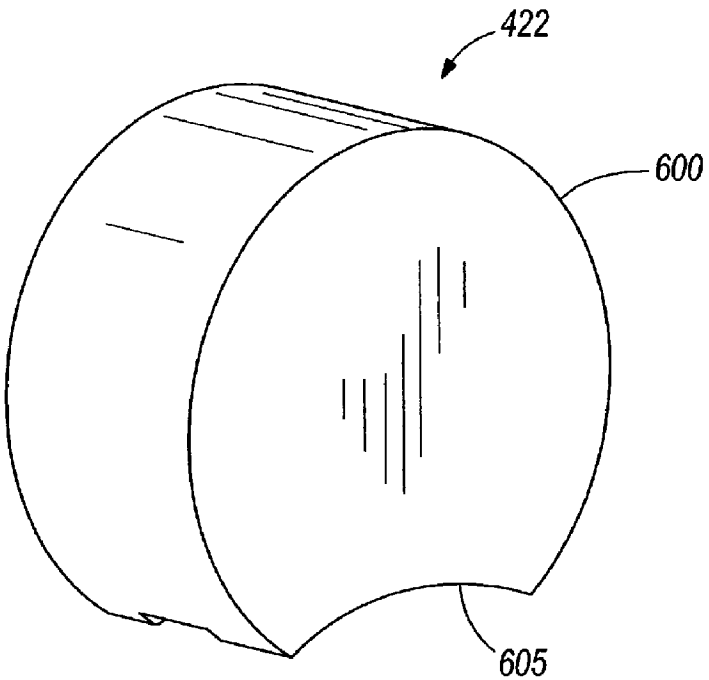
FIG. 19 is a perspective view of the face plate of FIG. 9.

FIG. 9 shows that the face plate 422 is attached to the actuating pin holder 425 adjacent the forward end of the housing 40 to secure the actuating pin holder 425 to the pin portion 70. As illustrated in FIGS. 19 and 20, the face plate 422 includes a substantially cylindrical body 600 that has a curved surface 605 and a pin holder attachment portion 610. The cylindrical body 600 engages the second interior surface 345 when the lock cylinder assembly 325 is inserted into the cavity 355. The curved surface 605 substantially corresponds to the curvature of the first end portion 110 of the plug 360, and engages the first end portion 110 when the face plate 422 is attached to the actuating pin holder 425. The face plate 422 is formed from a hardened material (e.g., steel, aluminum, etc.) that is resistant to drilling or other tampering methods.

The pin holder attachment portion 610 includes guide attachment members 615, a recessed surface 620, and sidewalls 625 that interconnect the guide attachment members 615 and the recessed surface 620. The guide attachment members 615, the recessed surface 620, and the sidewalls 625 cooperate to define a partially enclosed insertion groove 630 that extends from the curved surface 605 partially into the cylindrical body 600. When the face plate 422 is attached to the actuating pin holder 425, the insertion guides 490 are substantially engaged with the insertion groove 630, and each guide attachment member 615 is substantially engaged with the associated guide recess 500 of the insertion arms 465. Generally, the insertion guides 490, the insertion groove 630, the guide recesses 500, and the guide attachment members 615 cooperate with each other to securely attach the actuating pin holder 425 to the pin portion 70, and limit access to the pin portion 70 from outside the IC lock assembly 310.

FIG. 11 shows the IC lock assembly 310 with the appropriate key 315 inserted into the key slot 130 of the plug 360. The pin engaging portions 365 of the appropriate key 315 are engaged with each of the inner pins 150 to move the outer pins 140 to the shear line 395 without engaging the control pin 415. Once the outer pins 140 are moved to the shear line 395, the plug 360 can be rotated between the locked and unlocked positions.

The lock cylinder assembly 325 is assembled by inserting the plug 360 into the housing 40 after the inner pins 150, the control pin 415, and the anti-tamper pins 417 have been positioned in the plug 360. The plug 360 is assembled by inserting the inner pins 150 into the inner pin chambers 135, and by inserting the control pin 415 into the pin receiving chamber 410. The outer pins 140 are positioned in the outer pin chambers 95 after the plug 360 has been assembled and inserted into the housing 40. The springs 145 are inserted into the pin portion 70 after insertion of the outer pins 140 to bias the outer pins 140 and the inner pins 150 inward such that the outer pins 140 partially extend into the inner pin chambers 135.

The actuating ring 435 is rotatably attached to the second end portion 115 of the plug 360 and the actuating ring 435 is engaged with the outer surface 120 of the plug 360 and with the wall of the housing 40 after the plug 360 is inserted into the housing 40. The tailpiece 165 is engaged with the plug 360 inside the ring body portion 565. Generally, one of the pin slots of the tailpiece 165 is aligned with one of the holes in the plug 360 and with one of the plurality of arcuate recesses in the screw cap 160 during attachment of the screw cap 160 to the plug 360. The spring 215 is inserted into the associated hole of the plug 360 before the tailpiece 165 is attached to the plug 360. The screw cap 160 is threaded onto the second end portion 115 of the plug 360 to attach the tailpiece 165 to the plug 360, and secures the actuating ring 435 to the plug 360 so that the actuating ring 435 is permitted to pivot about the outer surface 120 of the plug 360 without axial movement of the actuating ring 435.

When the tailpiece 165 abuts the second end portion 115 and is securely sandwiched between the plug 360 and the screw cap 160, the alignment pin 200 is inserted into the associated pin hole 125 of the plug 360. The alignment pin 200 engages the pin slot of the tailpiece 165 to maintain alignment of the plug 360 and the tailpiece 165, and to rotationally attach the screw cap 160 and the tailpiece 165 to the plug 360. The outward shoulder 210 of the alignment pin 200 is engaged with the arcuate recess 180 of the screw cap 160 to retain the alignment pin 200 within the pin hole 125.

The actuating pin holder 425 is assembled onto the housing 40 by engaging the insertion rail 485 with the insertion slots on the pin portion 70 so that the actuating end 460 abuts the pin portion 70. The outer end of the pin portion 70 extends through the insertion channel 480. When the actuating pin holder 425 is assembled onto the housing 40 and the actuating ring 435 is coupled to the plug 360, the pin receiving portion 570 of the actuating ring 435 is disposed proximate to and substantially engaged with the cylindrical surface 510.

The face plate 422 is attached to the actuating pin holder 425 by sliding the insertion guides 490 of the actuating pin holder 425 into the insertion groove 630. When the face plate 422 is attached to the actuating pin holder 425, the curved portion of the face plate 422 abuts the first end portion 110 of the plug 360, and access to the pin portion 70 is substantially limited.

The actuating pin 430 and the spring 550 can be inserted into the first passageway 515 before or after the actuating pin holder 425 is attached to the housing 40. The pin bore 575 is substantially aligned with the second passageway 520 and the pin receiving chamber 410 after the actuating pin 430 is inserted into the first passageway 515 so that the connector pin 440 can be inserted through the second passageway 520, into the bore 555 of the actuating pin 430, and into the pin bore 575 of the actuating ring 435. The elongated portion 585 extends into the pin receiving chamber 410 into communication with the control pin 415, and the pin head portion 580 is substantially engaged with the pin receiving portion 570 and substantially disposed in the bore 555 of the actuating pin 430 after the connector pin 440 is inserted into the actuating pin holder 425 and the actuating ring 435. The connector pin 440 couples the actuating ring 435 to the actuating pin 430 such that pivotal movement of the actuating ring 435 moves the actuating pin 430 laterally between the engaged position and the disengaged position. The first passageway 515 allows pivotal movement of the connector pin 440 relative to the actuating pin holder 425.

The locking assembly is inserted into the second passageway 520 after the connector pin 440 is inserted into second passageway 520. The stop pin 445 is engaged with the actuating pin 430 within the engagement recess 560, and the spring 590 is engaged with the stop pin 445. The cover strip 400 is positioned in the shallow channel 505 of the actuating pin holder 425 and over the outer pin chambers 95 in the pin receiving channel after assembly of the housing 40, the plug 360, and the actuating mechanism 420.

FIGS. 24-33 show another construction of an IC lock cylinder assembly 725 for use with the lock assembly 310. Except as described below, the IC lock cylinder assembly 725 is the same as the IC lock cylinder assembly 325 described with regard to FIGS. 6-23, and common elements are given the same reference numerals.

Figure 24:
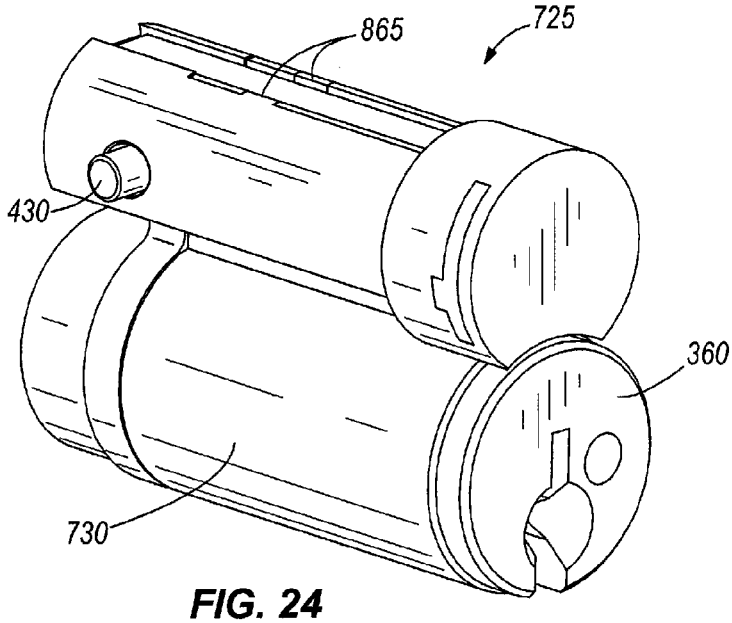
FIG. 24 is a perspective view of another interchangeable core lock cylinder assembly for the lock assembly of FIG. 6.
Figure 25:
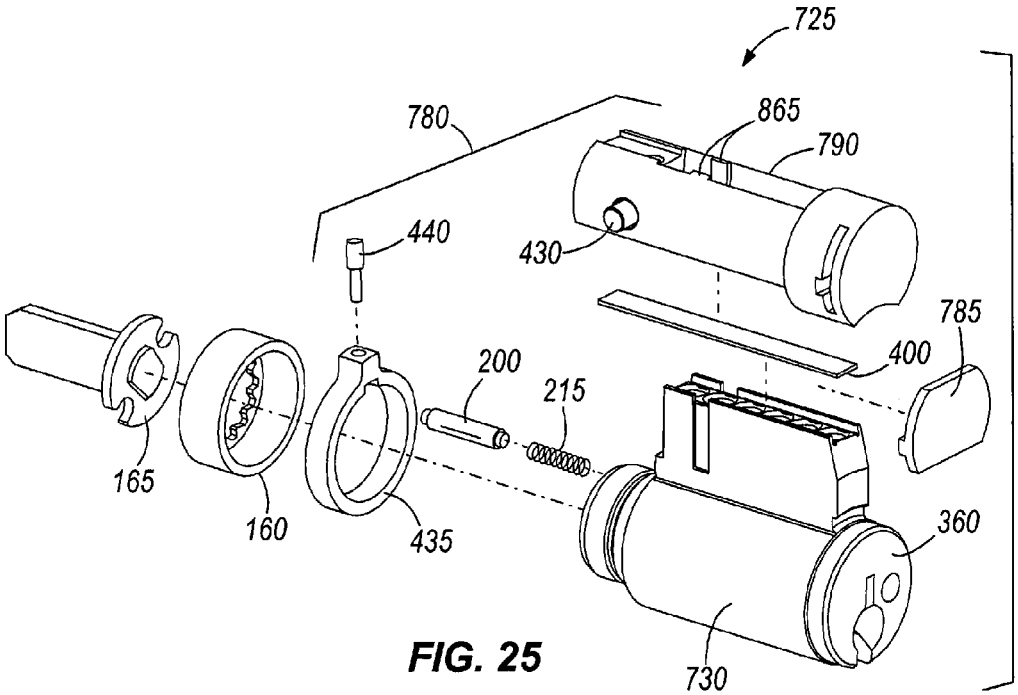
FIG. 25 is an exploded perspective view of the interchangeable core lock cylinder assembly of FIG. 24 that includes the plug, a housing, an actuating mechanism, and an anti-tamper plate.
Figure 26:
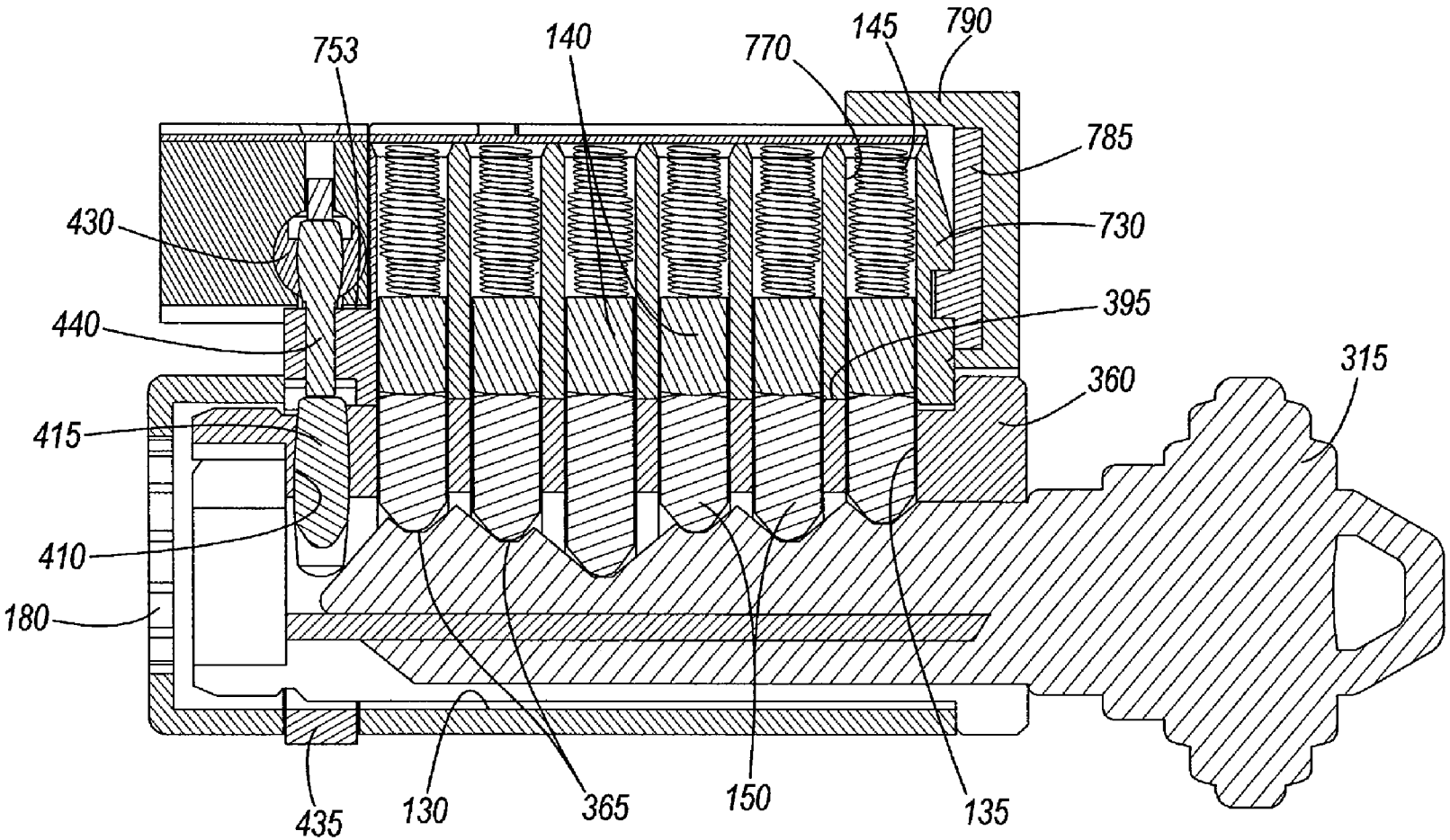
FIG. 26 is a section view of the interchangeable core lock cylinder assembly of FIG. 24 including a control key inserted into the plug.

FIGS. 24-26 show that the IC lock cylinder assembly 725 includes the plug 360 and a housing 730. The plug 360 is selectively rotatable within the housing 730. Upon insertion of the IC lock cylinder assembly 725 into the IC housing 320, the housing 730 is fixed relative to the IC housing 320 and the door, and the plug 360 is movable relative to the housing 730 between a locked position and an unlocked position using the key 315. As shown in FIG. 26, the plug 360 and the housing 730 cooperate with each other to define the shear line 395.

Figure 27:
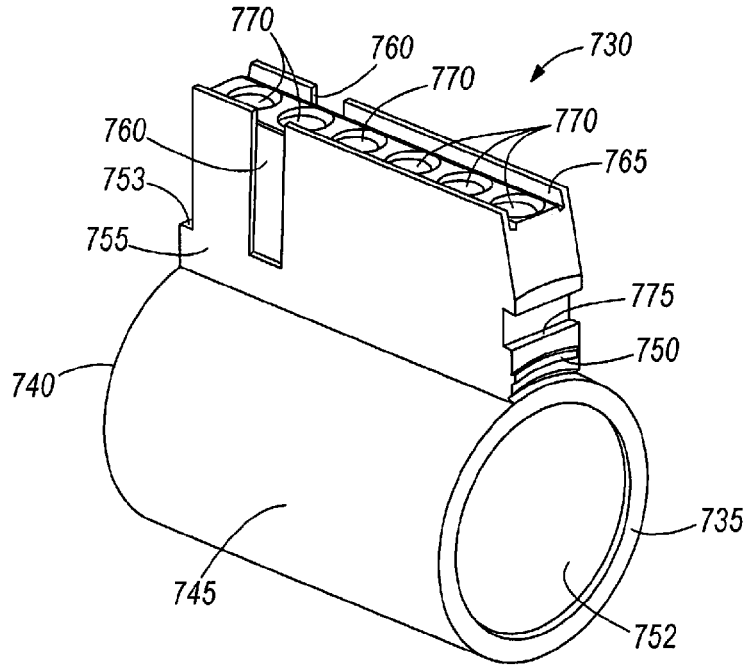
FIG. 27 is a perspective view of the housing of FIG. 25.

The housing 730 is similar to the housing 40 described with regard to FIGS. 1-23. FIG. 27 shows that the housing 730 includes a first end 735, a second end 740, a wall 745 and a pin portion 750. The wall 745 is substantially engageable with the first interior surface 340 when the IC lock cylinder assembly 725 is disposed in the cavity 355, and includes a substantially cylindrical portion that defines a hollow portion 752 that receives the plug 360.

The pin portion 750 extends above the wall 745 and defines a step 753 disposed adjacent the second end 740. The pin portion 750 includes exterior surfaces 755 (one shown), insertion slots 760, a pin cover channel 765, first or outer pin chambers 770, and an insertion guide 775. The insertion slots 760 are disposed in the exterior surfaces 755 and extend generally vertically downward (as viewed in FIG. 27) from the outer end of the pin portion 750 toward the wall 745. As shown in FIGS. 25-27, the outer pin chambers 770 are accessible through the cover strip 400 that is positioned in the pin cover channel 765. The outer pin chambers 770 extend inward into the pin portion 750 from adjacent the outer end of the pin portion 750. The insertion guide 775 is formed on the end of the pin portion 750 adjacent the first end 735. The insertion guide 775 is defined by a recess that extends through the pin portion 750 between the exterior surfaces 755.

FIGS. 25 and 26 show that the IC lock cylinder assembly 725 also includes the screw cap 160, the tailpiece 165, the alignment pin 200, the spring 215, the connector pin 415, an actuating mechanism 780, and an anti-tamper plate 785. The actuating mechanism 780 is coupled to the housing 730 and the plug 360, and is movable between a locked position and an unlocked position using the control key 370. Like the actuating mechanism 420, when the actuating mechanism 780 is in the locked position, the IC lock cylinder assembly 725 is locked into the IC housing 320 so that the IC lock cylinder assembly 725 cannot be removed from the IC housing 320 without the control key 370. When the actuating mechanism 780 is in the unlocked position, the IC lock cylinder assembly 725 is removable from the IC housing 320.

Figure 28:
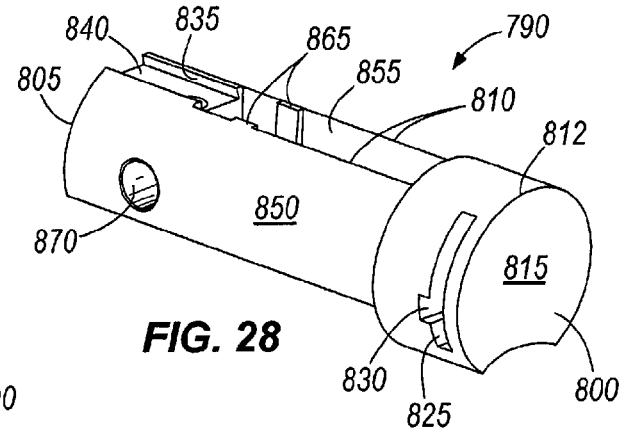
FIG. 28 is a perspective view of an actuating pin holder of the actuating mechanism of FIG. 25.
Figure 29:
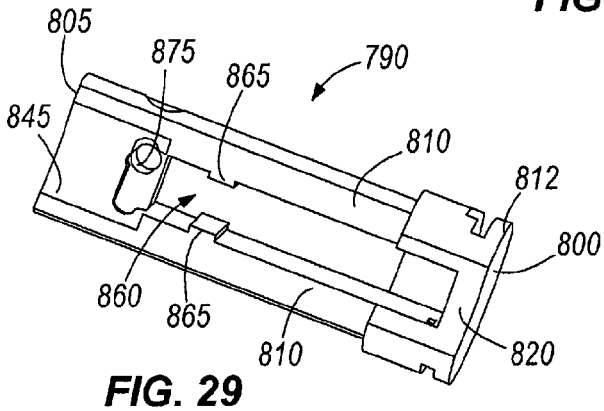
FIG. 29 is another perspective view of the actuating pin holder.

The actuating mechanism 780 includes the actuating ring 435, the actuating pin 430, the connector pin 440, the stop pin 445, the spring 590 (see FIGS. 17 and 26), and an actuating pin holder 790. FIGS. 25, 28, and 29 show that the actuating pin holder 790 includes a first or faceplate end 800, a second or actuating end 805, and two insertion arms 810 that extend between the first end 800 and the second end 805 substantially parallel to each other. The faceplate end 800 and the actuating end 805 are fixed relative to the insertion arms 810 to connect the insertion arms 810 to each other to form the unitary actuating pin holder 790.

Generally, the faceplate end 800 limits access to the pin portion 750 from outside the IC lock assembly 310. The faceplate end 800 defines a face plate 812 that has a faceplate surface 815 adjacent the first end 735 of the housing 730. The faceplate end 800 is substantially cylindrically-shaped and has a curved surface 820 and a plate recess or slot 825. The cylindrically-shaped faceplate end 800 engages the second interior surface 345 when the lock cylinder assembly 725 is inserted into the cavity 355. The curved surface 820 substantially corresponds to the curvature of the first end portion 110 of the plug 360, and engages the first end portion 110 when the actuating pin holder 790 is coupled to the housing 730.

The plate recess 825 is spaced a distance from the faceplate surface 815 and extends laterally through the faceplate end 800. The plate recess 825 defines an attachment slot 830 adjacent a central portion of the plate recess 825. In some constructions, the plate recess 825 may extend partially through the faceplate end 800 from one side of the actuating pin holder 790.

FIG. 26 shows that the actuating end 805 is positioned around the housing 730 adjacent the step 753. The step 753 provides clearance between the pin portion 750 and the actuating end 805 so that the housing 730 and the actuating pin holder 790 can be coupled together. As shown in FIG. 28, the actuating end 805 includes an upper portion that has a shallow groove or channel 835 that is defined by a surface 840 and that receives a portion of the cover strip 400. As shown in FIG. 29, a lower portion of the actuating end 805 is defined by a substantially cylindrical surface 845. The cover strip 400 is coupled to the actuating end 805 and to the outer end of the pin portion 750 in the pin cover channel 765 to retain the outer pins 140, the inner pins 150, and the springs 145 in the housing 730 and the plug 360.

The insertion arms 810 are spaced apart from each other and include exterior surfaces 850 and interior surfaces 855. The exterior surfaces 850 extend between the faceplate end 800 and the actuating end 805, and substantially engage a portion of the second interior surface 345 of the IC housing 320 when the lock cylinder assembly 325 is inserted into the cavity 355. The interior surfaces 855 define an insertion channel 860 that extends through the actuating pin holder 790 between the faceplate end 800 and the actuating end 805. The pin portion 750 is disposed in the insertion channel 860 when the lock cylinder assembly 725 is assembled such that the outer pin chambers 770 are substantially accessible through the actuating pin holder 790.

FIGS. 28 and 29 show that each insertion arm 810 also includes an insertion rail 865 protruding from the interior surface 855 into the insertion channel 860 and extending through the actuating pin holder 790 between an upper side of the insertion arm and a lower side of the insertion arm. In other words, the insertion rails 865 extend substantially vertically through the actuating pin holder 790 as viewed in FIG. 28. The actuating pin holder 425 is attachable to the housing 730 by engaging the insertion rails 865 with the respective insertion slots 760 on the pin portion 750.

The actuating pin holder 790 also includes a first bore or passageway 870 that is defined by a cylindrical shape that receives the actuating pin 430, and a second bore or passageway 875 that receives the stop pin 445 and the spring 590. In other constructions, the first passageway 870 may be at least partially defined by other shapes (e.g., truncated cylindrical shape, rectangular shape, triangular shape, etc.). The remaining characteristics and features of the first passageway 850 and the second passageway 875 are the same as the characteristics and features of the first passageway 515 and the second passageway 520 described with regard to FIGS. 6-23, and will not be discussed in detail.

Figure 30:
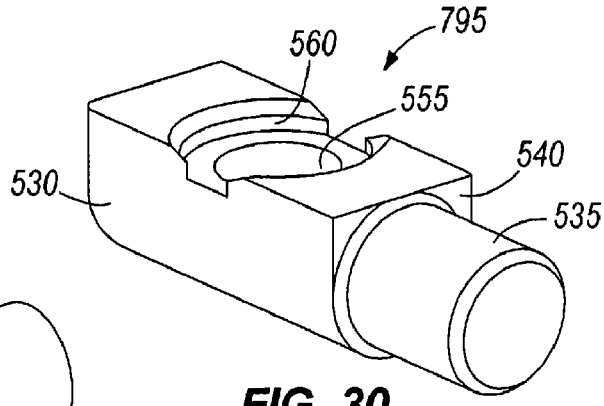
FIG. 30 is a perspective view of an actuating pin of the actuating mechanism of FIG. 25.
Figure 31:
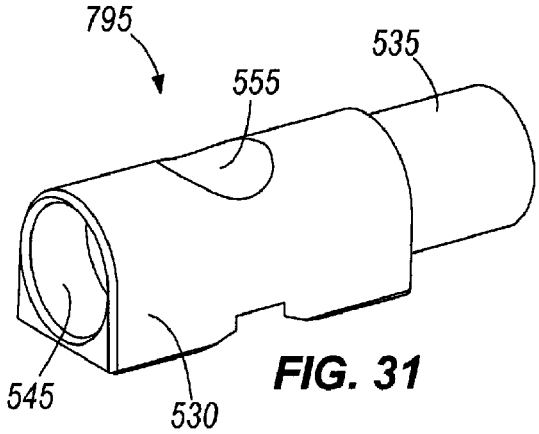
FIG. 31 is another perspective view of the actuating pin.

FIGS. 30 and 31 show another actuating pin 795 for use with the IC lock cylinder assembly 725. The actuating pin 795 may be disposed in the first passageway 870 in constructions of the actuating pin holder 790 in which the first passageway 870 has a truncated cylindrical shape. The actuating pin 795 is defined by a truncated cylindrical shape that ensures surface contact between the actuating pin holder 790 and the actuating pin 795 when the first passageway 870 is defined by a truncated cylindrical shape to minimize stress on the actuating pin holder 790 and the actuating pin 795. The remaining characteristics and features of the actuating pin 795 are the same as the characteristics and features of the actuating pin 430 described with regard to FIGS. 6-23, and will not be discussed in detail.

Figure 32:
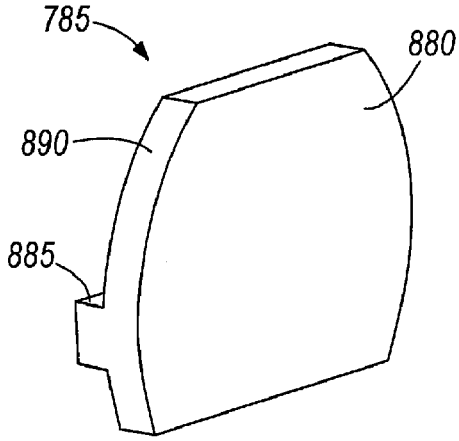
FIG. 32 is a perspective view of the anti-tamper plate of FIG. 25.
Figure 33:
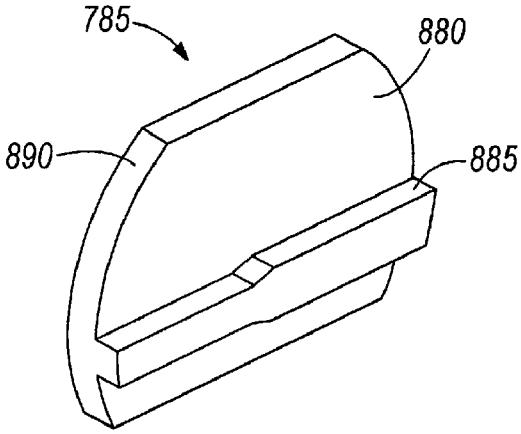
FIG. 33 is another perspective view of the anti-tamper plate.

As illustrated in FIGS. 32 and 33, the anti-tamper plate 785 is insertable into the plate recess 825, and includes a plate portion 880 and an attachment boss 885 that extends across the plate portion. The plate portion 880 and the attachment boss 885 generally conform to the shape of the plate recess 825. The plate portion 880 has curved outer surfaces 890 that conform to the curvature of the faceplate end 800.

The attachment boss 885 is engageable with the attachment slot 830, and is further engageable with the insertion guide 775 to securely attach the actuating pin holder 790 to the housing 730. For example, in some constructions, the attachment boss 885 may be press fit into the insertion guide 775 to securely hold the actuating pin holder 790 on the pin portion 750. As shown in FIG. 33, the attachment boss 885 is tapered from a first size adjacent one side of the plate portion 880 to a smaller size adjacent the other side of the plate portion 880 to allow insertion and removal of the anti-tamper plate 785 relative to the plate recess 825. The larger portion of the attachment boss 885 is in close-fitting (e.g., press fit) relationship with the insertion guide 775 and the attachment slot 830. The anti-tamper plate 785 is formed from a hardened material (e.g., steel, aluminum, etc.) that is resistant to drilling or other tampering methods. Generally, the faceplate end 800 and the anti-tamper plate 785 cooperate with each other to limit access to the pin portion 750 from outside the IC lock assembly 310.

Except as described below, assembly of the IC lock cylinder assembly 725 is the same as assembly of the IC lock cylinder assembly 325 described with regard to FIGS. 6-23.

The actuating pin holder 790 is assembled onto the housing 730 by engaging the insertion rails 865 with the insertion slots 760 on the pin portion 750 so that the faceplate end 800 and the actuating end 805 abut the respective ends of the pin portion 750. The outer end of the pin portion 750 extends through the insertion channel 860. When the actuating pin holder 790 is assembled onto the housing 730 and the actuating ring 435 is coupled to the plug 360, the pin receiving portion 570 of the actuating ring 435 is disposed proximate to and substantially engaged with the cylindrical surface 845.

The anti-tamper plate 785 is attached to the actuating pin holder 790 by sliding the anti-tamper plate 785 into the plate recess 825. The attachment boss 885 is aligned and engaged with the attachment slot 830 upon insertion of the anti-tamper plate 785 into the plate recess 825. The attachment boss 885 is further tightly engaged with the insertion guide 775, securing the actuating pin holder 790 to the housing 730. When engaged with the plate recess 825, the anti-tamper plate 785 resists removal of the actuating pin holder 790 from the housing 730 via the attachment boss 885, which inhibits vertical movement of the actuating pin holder 790 relative to the housing 730. The curved outer surfaces 890 conform to the curvature of the faceplate end 800 and the curved portion of the faceplate end 800 abuts the first end portion 110 of the plug 360, and access to the pin portion 750 is substantially limited.

Except as described below, operation of the IC lock assembly 310 is similar to the operation KIK lock assembly 310 described with regard to FIGS. 1-5. Generally, the IC lock cylinder assembly 325 or the IC lock cylinder assembly 725 may be inserted into the IC housing 320. Operation of the IC lock assembly 310 including the IC lock cylinder assembly 725 is the same as operation of the IC lock assembly 310 including the IC lock cylinder assembly 325. For the sake of brevity, only operation of the IC lock assembly 310 including the IC lock cylinder assembly 325 will be described herein.

The IC lock cylinder assembly 325 is secured to the IC housing 320 using the actuating mechanism 420. The control key 370 is inserted into the key slot 130 to engage the control pin 415 and to move the actuating pin 430 between the engaged position and the disengaged position.

FIG. 21 shows the IC lock cylinder assembly 325 prior to insertion into the IC housing 320, and prior to insertion of the control key 370 or the appropriate key into the key slot 130. As illustrated in FIG. 21, the IC lock cylinder assembly 325 is in a normal position that is defined by the actuating pin 430 positioned in the engaged position and the outer and inner pins 140, 150 biased inward by the springs 145. The control pin 415 is disposed in the key slot 130 and completely within the plug 360 after the IC lock cylinder assembly 325 is assembled. In the normal position, the actuating pin 430 is biased outward from the actuating pin holder 425 by the spring 550, and the bore 555 of the actuating pin 430 is substantially aligned with the second passageway 520. The stop pin 445 is biased into engagement with the engagement recess 560 by the spring 590, which in turn biases the connector pin 440 downward into engagement with the pin receiving portion 570 and the control pin 415.

FIG. 22 shows the IC lock cylinder assembly 325 with the control key 370 inserted into the key slot 130. The control key 370 controls movement of the outer and inner pins 140, 150, as well as movement of the actuating mechanism 420 via the control pin 415. When the control key 370 is inserted into the key slot 130, the pin engaging portions engage the inner pins 150 to move the outer pins 140 to the shear line 395. The projection of the control key 370 engages the control pin 415 and moves the control pin 415 into engagement with the connector pin 440. The connector pin 440 is moved by the control pin 415 into engagement with the stop pin 445, which in turn moves the stop pin 445 out of the engagement recess 560.

As illustrated in FIG. 23, after the stop pin 445 and the actuating pin 430 are no longer engaged with each other, the actuating pin 430 can be moved from the engaged position to the disengaged position for insertion of the IC lock cylinder assembly 325 into the IC housing 320. FIG. 23 illustrates the IC lock cylinder assembly 325 in a control position. The control key 370 is rotated in a first direction (e.g., clockwise) to move the actuating pin 430 from the engaged position to the disengaged position. Rotational movement of the control key 370 rotates the plug 360 and the actuating ring 435, and rotation of the actuating ring 435 is translated to linear motion of the actuating pin 430. After the actuating pin 430 is moved to the disengaged position, the IC lock cylinder assembly 325 is inserted into the IC housing 320.

When the IC lock cylinder assembly 325 is disposed within the IC housing 320, the control key 370 is rotated in a second direction (e.g., counter-clockwise) to rotate the plug 360 and the actuating ring 435, which translates to linear movement of the actuating pin 430 from the disengaged position to the engaged position. The actuating pin 430 is engaged with the locking hole 350 to secure the IC lock cylinder assembly 325 in the IC housing 320. Rotation of the control key 370 in the second direction adjusts the IC lock cylinder assembly 325 from the control position to the normal position, and the control key 370 can be removed from the key slot 130 after the IC lock cylinder assembly 325 is repositioned in the normal position. In other words, the control key 370 can be removed from the key slot 130 after the IC lock cylinder is locked in the IC housing 320.

The appropriate key can be inserted into the key slot 130 to move the plug 360 between the locked and unlocked positions. Like the pin engaging portions of the control key 370, the pin engaging portions of the appropriate key engage the inner pins 150 to move the outer pins 140 to the shear line 395. Unlike the control key 370, the appropriate key does not engage the control pin 415, and therefore cannot engage the actuating pin 430. The plug 360 is rotated to lock or unlock the door after the outer pins 140 are aligned with the shear line 395, which in turn rotates the screw cap 160 and the tailpiece 165 to move the deadbolt between the locked and unlocked positions.

The desired locking characteristics of the IC lock assembly 310 can be varied by replacing the IC lock cylinder assembly 325 with different IC lock cylinder assemblies within the IC housing 320. Use of different lock cylinder assemblies with the same IC housing 320 allows relatively quick change of the locking characteristics without replacement of the entire lock assembly 310. The process for replacing the IC lock cylinder assembly 325 with a second IC lock cylinder assembly 325 is accomplished by reversing the order of the steps described above with regard to FIGS. 20-22. More particularly, the control key 370 is inserted into the key slot 130 of the assembled lock assembly 310 to engage the inner pins 150 and the connector pin 440, and the connector pin 440 is moved by the control key 370 into the bore 555 of the actuating pin 430.

As described above, after the control key 370 is inserted into the key slot 130, the IC lock cylinder assembly 325 is adjusted from the normal position to the control position to move the actuating pin 430 from the engaged position to the disengaged position, which removes the actuating pin 430 from the locking hole 350. After the IC lock cylinder assembly 325 is removed from the IC housing 320, the second IC lock cylinder assembly 325 can be inserted into the IC housing 320 using the same process described above with regard to FIGS. 20-22, which will not be described in detail. In this manner, the lock cylinder assembly 325 of the lock assembly 310 can be easily and relatively quickly changed to alter the locking characteristics of the lock assembly 310 without professional assistance.

Figure 40:
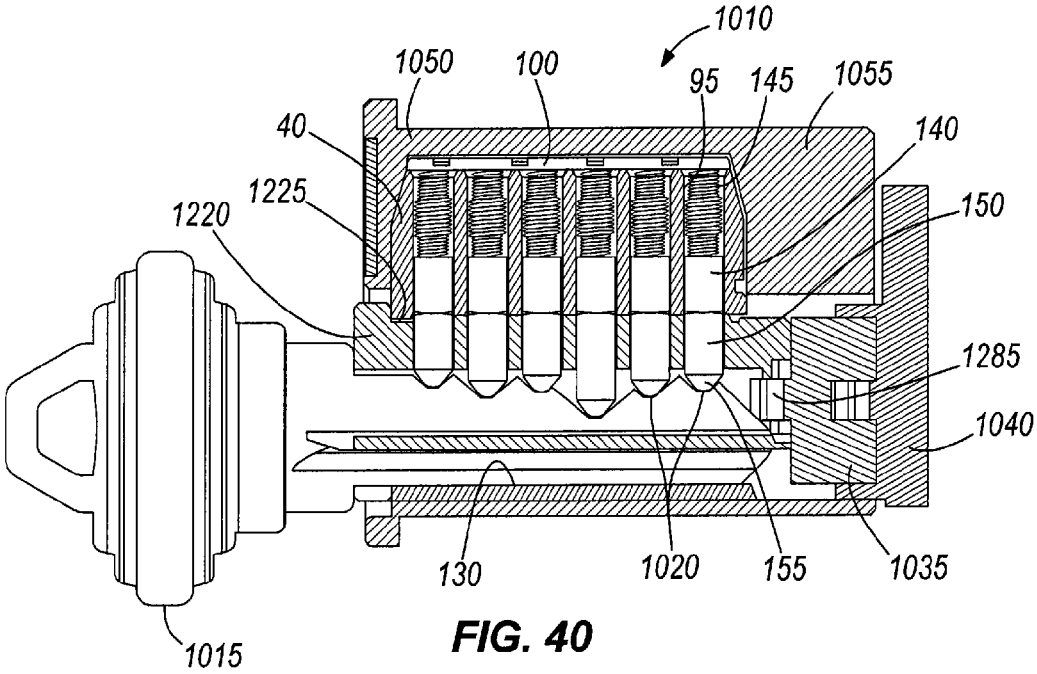
FIG. 40 is a section view of the mortise lock assembly of FIG. 34.
Figure 41:
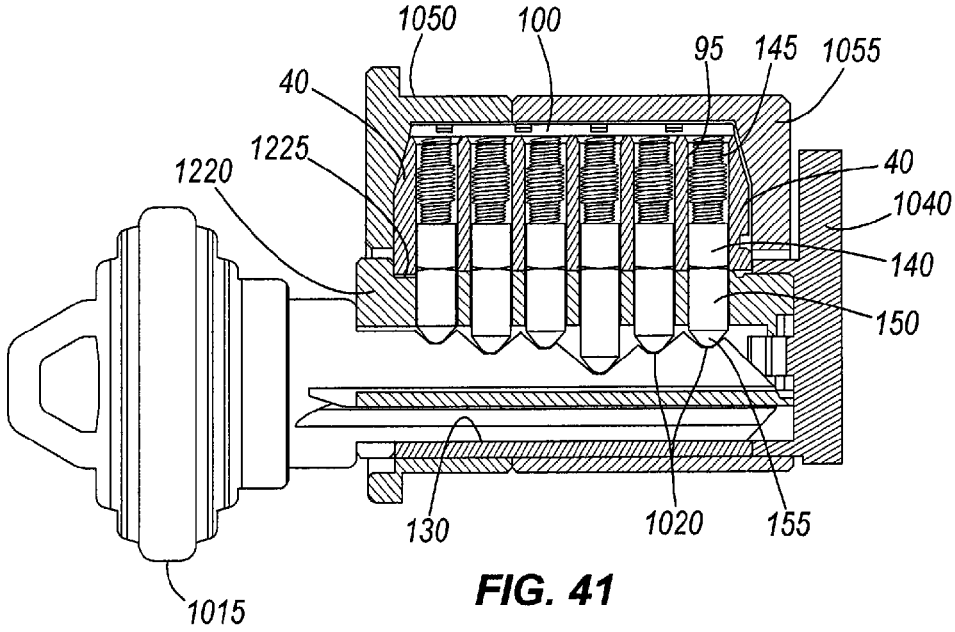
FIG. 41 is a section view of another mortise lock assembly that is without the extension.

FIGS. 34-47 show another construction of a lock assembly 1010 for use with the door. Except as described below, the lock assembly 1010 is similar to the lock assembly 10 that is described with regard to FIGS. 1-5, and common elements are given the same reference numerals. The lock assembly 1010 that is illustrated in FIGS. 34-47 is a mortise lock assembly that is lockable and unlockable using an appropriate key 1015 that is similar to the key 15, and that includes pin engaging portions 1020 (FIGS. 40 and 41). Generally, the mortise lock assembly 1010 cooperates with a mortise chassis (not shown) that is disposed in the door to lock and unlock the door.

Figure 34:
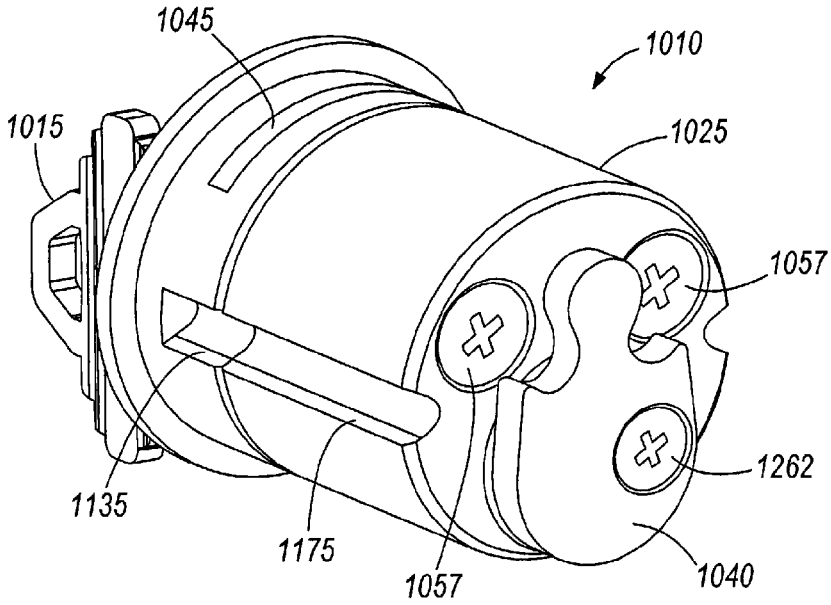
FIG. 34 is a perspective view of a mortise lock assembly embodying the invention.
Figure 35:
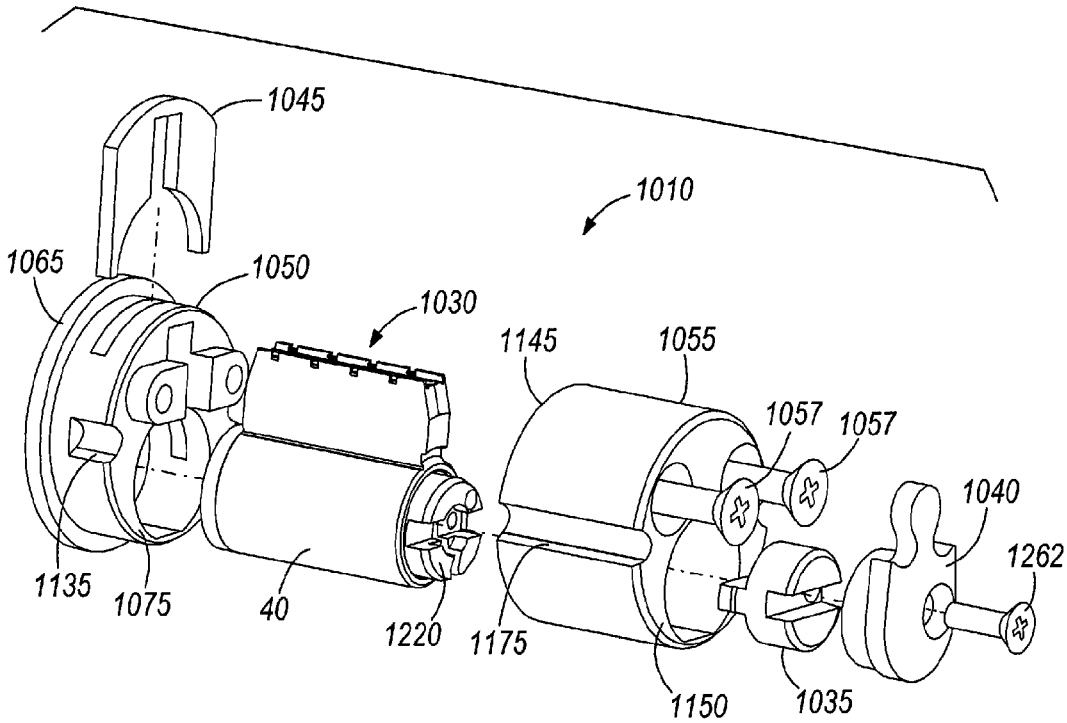
FIG. 35 is an exploded perspective view of the mortise lock assembly of FIG. 34 including a mortise housing, a lock cylinder assembly, an extension, and a cam.

FIGS. 34 and 35 show that the mortise lock assembly 1010 includes a mortise housing 1025, a lock cylinder assembly 1030, an extension 1035, and a cam 1040. In the illustrated construction, the mortise lock assembly 1010 also includes an anti-tamper plate 1045. The anti-tamper plate 1045 is formed from a hardened material (e.g., steel, aluminum, etc.) that is resistant to drilling or other tampering methods, and generally conforms to the shape of the mortise housing 1025. In other constructions, the mortise lock assembly 1010 may be provided without an anti-tamper plate.

Figure 37:
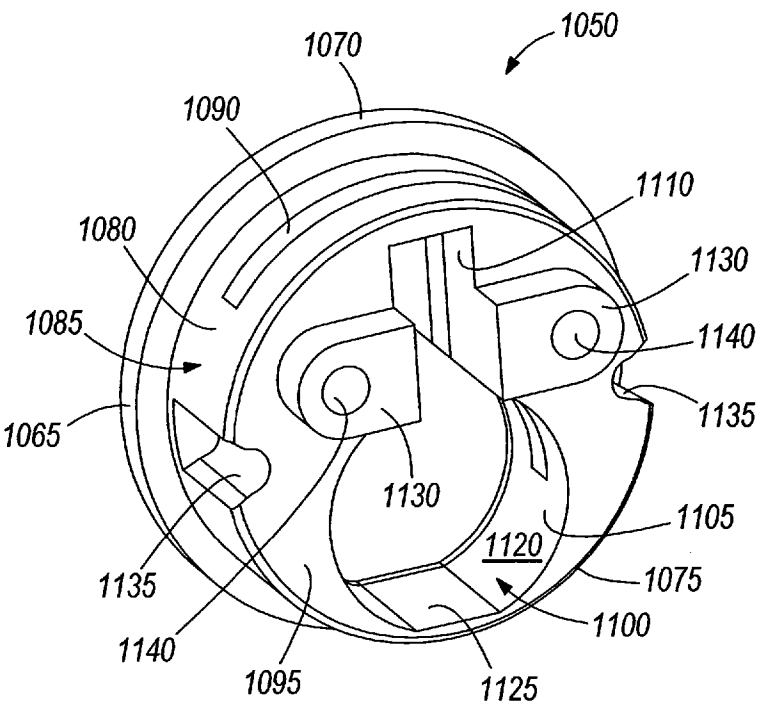
FIG. 37 is another perspective view of the first mortise housing portion.
Figure 36:
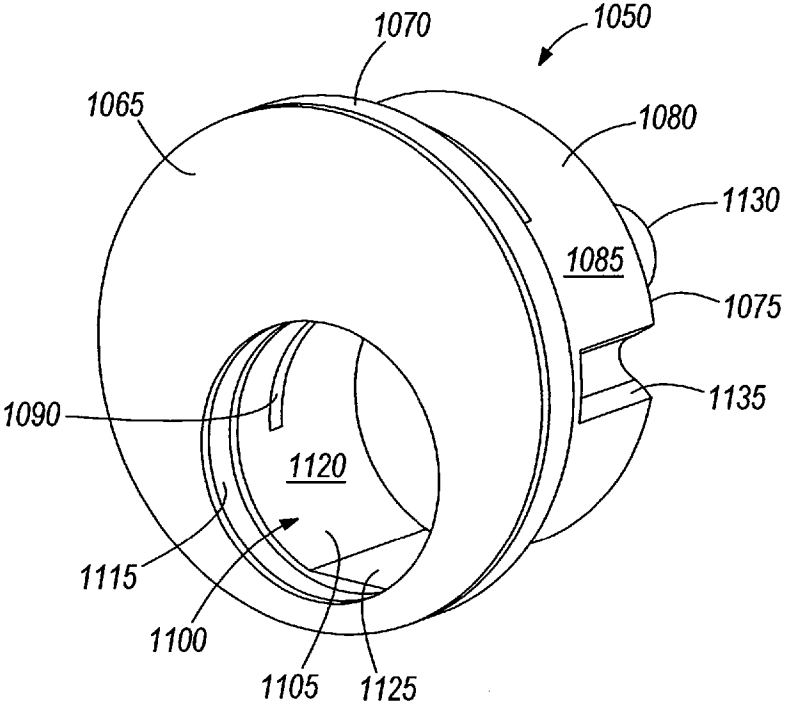
FIG. 36 is a perspective view of a first mortise housing portion of the mortise housing of FIG. 35.

The mortise housing 1025 has a first housing portion 1050 and a second housing portion 1055 that is attached to the first housing portion 1050 with fasteners 1057 (e.g., screws, bolts, etc.). The first housing portion 1050 defines a front or forward portion of the mortise housing 1025. FIGS. 36 and 37 show that the first housing portion 1050 includes a first end 1065 that has a rim 1070 abutting the door and accessible from outside the door, and a second end 1075 having a substantially cylindrical first housing body portion 1080 that extends from the rim 1070 into the door. The first housing body portion 1080 extends into the door when the mortise lock assembly 1010 is attached to the door, and includes an outer surface 1085, an end surface 1095, and a cavity 1100. The outer surface 1085 is engageable with an interior portion of the door.

In constructions of the mortise lock assembly 1010 that include the anti-tamper plate 1045, the anti-tamper plate 1045 is disposed in an anti-tamper slot 1090 adjacent the first end 1065 of the first housing portion 1050. In these constructions, the anti-tamper slot 1090 is recessed inward from the outer surface 1085 into the first housing body portion 1080 (i.e., generally downward as viewed in FIG. 37) adjacent the first end 1065, and is in communication with the cavity 1100. In constructions of the mortise lock assembly 1010 without an anti-tamper plate, the first housing portion 1050 may not include the anti-tamper slot 1090.

As illustrated in FIGS. 36 and 37, the cavity 1100 includes a first cavity portion 1105 that extends completely through the first housing portion 1050, a second cavity portion 1110 that extends from the second end 1075 toward the first end 1065, and a recess portion 1115 that extends into the first housing body portion 1080 adjacent the first end 1065. The first cavity portion 1105 and the second cavity portion 1110 are in communication with each other and generally cooperate to conform to the shape of the lock cylinder assembly 1030. The illustrated first cavity portion 1105 is defined by a cylindrical surface 1120 and a substantially planar surface 1125 that is opposite the second cavity portion 1110 adjacent the bottom of the first cavity portion 1105.

The first cavity portion 1105 is accessible from adjacent the first end 1065 and the second end 1075. FIG. 37 shows that the second cavity portion 1110 extends from the end surface 1095 partially through the first housing body portion 1080, and is defined by a substantially rectangular-shaped cross section. The recess portion 1115 receives a face plate (not shown) that is engaged with the first end 1065 of the first housing portion 1050, and that is partially disposed in the recess portion 1115 to retain the face plate on the mortise housing 1025.

The first housing portion 1050 also includes housing attachment portions 1130 and first attachment channels 1135. The housing attachment portions 1130 protrude outward from the end surface 1095, and include threaded holes 1140 that receive ends of the fasteners 1057. The first attachment channels 1135 are disposed in the outer surface 1085 of the first housing portion 1050 and are spaced apart from each other by approximately 180 degrees along the perimeter of the first housing body portion 1080.

The first attachment channels 1135 extend longitudinally into the first housing body portion 1080 from the second end 1075 toward the first end 1065. The first attachment channels 1135 receive elongated screws or other fasteners (not shown) of the mortise chassis to lock the mortise housing 1025 from rotation after the mortise housing 1025 is engaged with the mortise chassis.

Figure 38:
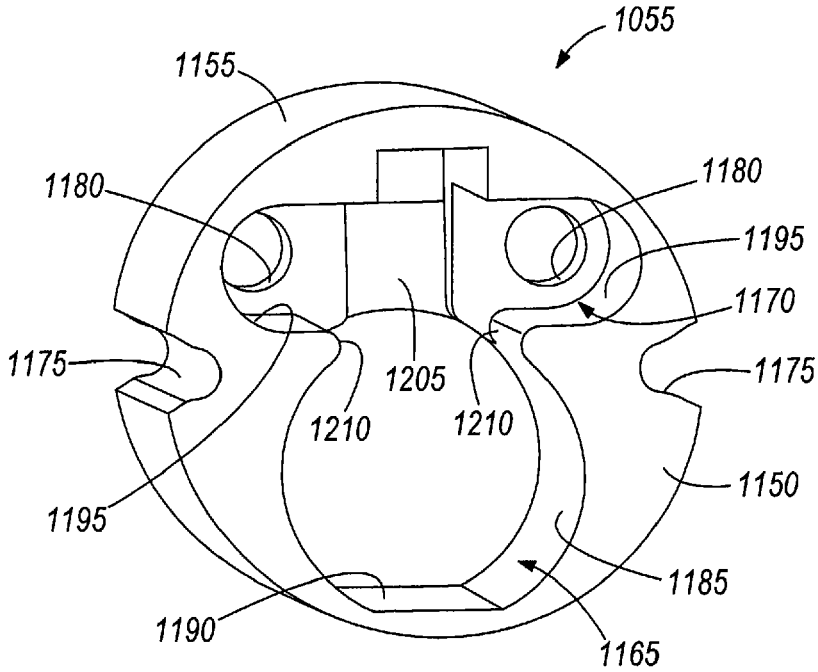
FIG. 38 is a perspective view of a second mortise housing portion of the mortise housing of FIG. 35.
Figure 39:
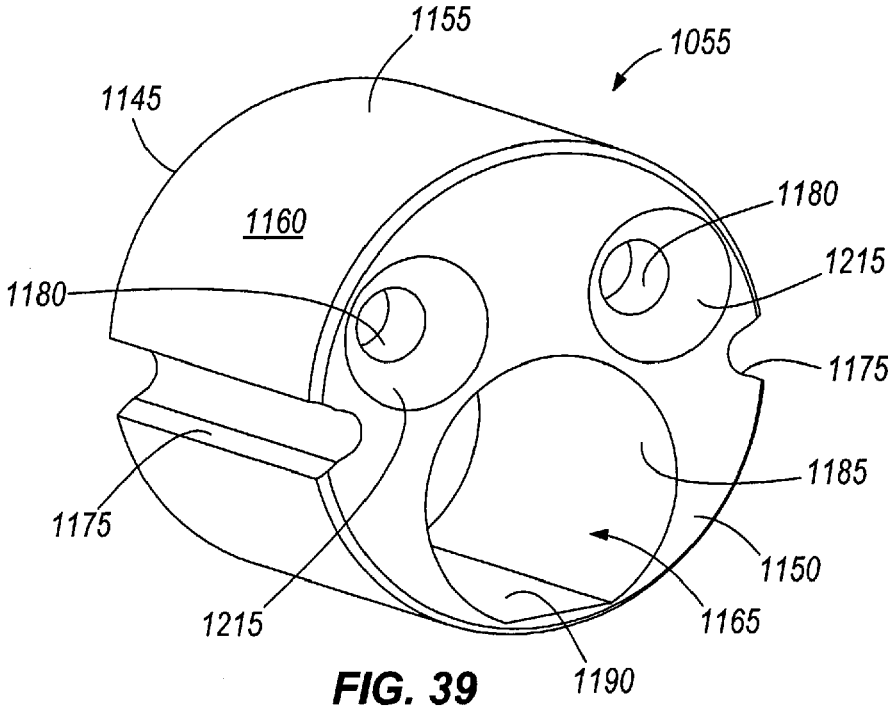
FIG. 39 is another perspective view of the second mortise housing portion.

FIGS. 35, 38, and 39 show that the second housing portion 1055 defines a back or rearward portion of the mortise housing 1025. The second housing portion 1055 includes a first end 1145 that is attachable to the first housing portion 1050, and a second end 1150 that is positionable adjacent the mortise chassis. The second housing portion 1055 is defined by a substantially cylindrical second housing body portion 1155 that includes an exterior surface 1160, a first cavity 1165, a second cavity 1170, second attachment channels 1175, and holes 1180. In some constructions, the exterior surface 1160 can be at least partially threaded to threadably engage a threaded portion of the mortise chassis (not shown).

FIGS. 38 and 39 show that the first cavity 1165 extends through the second housing portion 1055 from the first end 1145 to the second end 1150. The first cavity 1165 is in communication with the second cavity 1170 to receive a portion of the lock cylinder assembly 1030, and to further receive the cam 1040 and the extension 1035. The first cavity 1165 includes a cylindrical surface 1185 and a substantially flat surface 1190. The lock cylinder assembly 1030 is substantially engaged with the second housing portion 1055 within the first cavity 1165.

FIG. 38 shows that the second cavity 1170 is recessed into the second housing portion 1055 from the first end 1145. The second cavity 1170 extends partially through the second housing body portion 1155, and is defined by symmetrical curved surfaces 1195 and a substantially rectangular cavity portion 1205. The curved surfaces 1195 are disposed on each side of the rectangular cavity portion 1205. The opposed curved surfaces 1195 cooperate to conform to the shape of the housing attachment portions 1130 so that the second housing portion 1055 can be attached to the first housing portion 1050 without a gap between the first and second housing portions 1050, 1055. The rectangular cavity portion 1205 is recessed into the second housing portion 1055 to conform to the shape of an upper portion of the lock cylinder assembly 1030. The second cavity 1170 is in communication with the first cavity 1165 adjacent a transition wall 1210.

FIGS. 34, 38, and 39 show that the second attachment channels 1175 are disposed in the exterior surface 1160 of the second housing portion 1055. The second attachment channels 1175 are spaced apart from each other by approximately 180 degrees along the perimeter of the second housing body portion 1155. The second attachment channels 1175 extend from the first end 1145 to the second end 1150 completely through the second housing portion 1055, and are aligned with the first attachment channels 1135 of the first housing portion 1050 to receive the elongated fasteners of the mortise chassis to lock the mortise housing 1025 from rotation after the mortise housing 1025 is engaged with the mortise chassis.

The holes 1180 extend into the second housing body portion 1155 from adjacent the second end 1150, and are in communication with the second cavity 1170. As illustrated in FIG. 38, the holes 1180 are partially defined by counter bores 1215 adjacent the second end 1150 so that ends of the fasteners 1057 can be recessed within the second housing portion 1055 and oriented substantially flush with the second end 1150. When the second housing portion 1055 is attached to the first housing portion 1050, the holes 1180 are in communication with the holes 1140 of the first housing portion 1050 to facilitate attachment of the second housing portion 1055 to the first housing portion 1050 using the fasteners 1057.

FIG. 35 shows that the lock cylinder assembly 1030 is insertable into the first housing portion 1050 within the cavity 1100, and is also insertable into the second housing portion 1055 within the first cavity 1165 and the second cavity 1170. FIGS. 35, 40, and 41 show that the lock cylinder assembly 1030 includes the housing 40 and a plug 1220 that is selectively rotatable within the housing 40. The housing 40 that is illustrated in FIG. 40 is longer than the housing 40 illustrated in FIG. 41. Other than the length, the housings 40 shown in FIGS. 40 and 41 are the same.

The flat outer surface 77 of the housing 40 engages the planar surface 1125 and engages the flat surface 1190 when the lock cylinder assembly 1030 is inserted into the first and second housing portions 1050, 1055. Upon insertion of the lock cylinder assembly 1030 into the mortise housing 1025, the housing 40 is fixed relative to the mortise housing 1025 and the door, and the plug 1220 is movable relative to the housing 40 and the mortise housing 1025 between a locked position and an unlocked position using the key 1015.

As shown in FIGS. 40 and 41, the housing 40 and the plug 1220 cooperate with each other to define a shear line 1225. The outer pin chambers 95 are accessible through the cover strip 100 that is positioned in the pin cover channel 90 adjacent the outer end of the pin portion 70.

Except as described below, the plug 1220 is similar to the plug 45 that is described with regard to FIGS. 1-5, and common elements are given the same reference numerals. In some constructions, the plug 1220 is the same as the plug 45.

Figure 42:
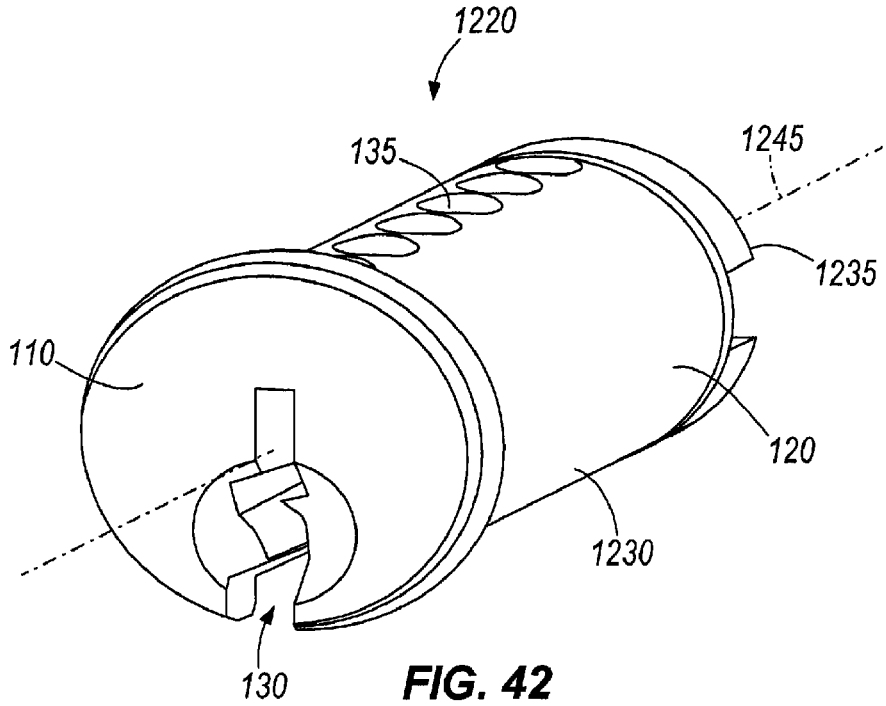
FIG. 42 is a perspective view of a plug of the lock cylinder assembly of FIG. 35.
Figure 43:
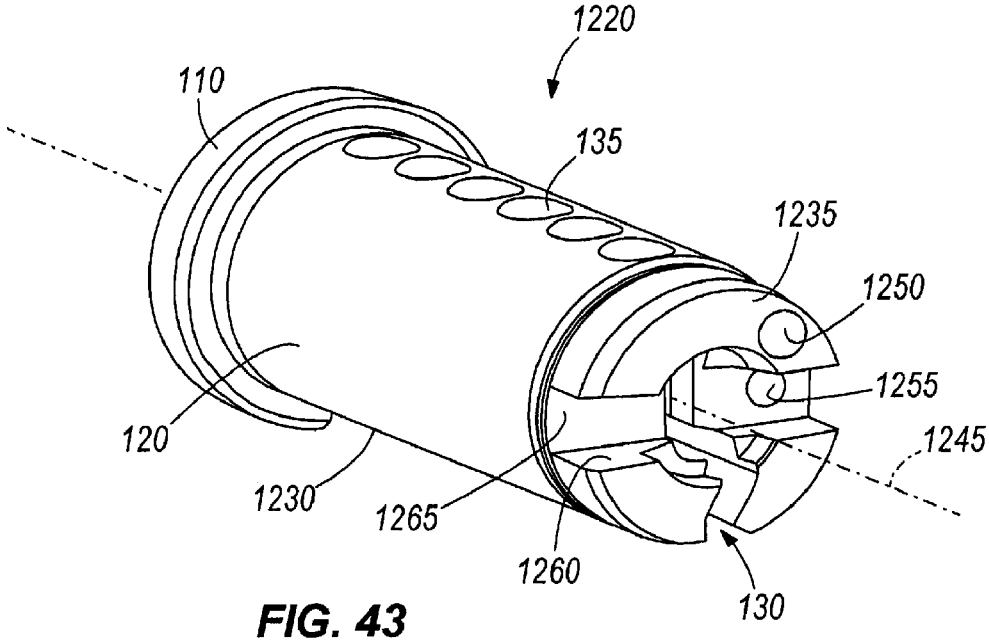
FIG. 43 is another perspective view of the plug.

FIGS. 42 and 43 show that the plug 1220 includes a body 1230 that is rotatable relative to the housing 40. The body 1230 is defined by the first end portion 110, the outer surface 120, and a second end portion 1235. A longitudinal axis 1245 extends through the plug 1220 from the first end portion 110 to the second end portion 1235. The first end portion 110 is accessible from the front of the mortise lock assembly 1010. The second end portion 1235 is accessible from the rear of the mortise lock assembly 1010. In some constructions, the second end portion 1235 is unthreaded. In other constructions, the second end portion 1235 may be threaded.

FIGS. 40-43 show that the plug 1220 includes the key slot 130, the inner pin chambers 135, a first hole 1250, a second hole 1255, and a drive channel 1260 that is located adjacent the second end portion 1235. The inner pins 150 are disposed within each of the inner pin chambers 135. The cover strip 100 is disposed in the pin cover channel 90 to retain the outer pins 140, the springs 145, and the inner pins 150 within the housing 40 and the plug 1220. The first hole 1250 is a locator hole that is positioned adjacent the outer surface 120.

FIG. 43 shows that the second hole 1255 is located adjacent the outer surface 120 of the plug 1220 and spaced apart from the first hole 1250. The second hole 1255 is further spaced apart or offset from the longitudinal axis 1245 of the plug 1220. In some constructions, the second hole 1255 includes threads that are threadably engaged by a fastener 1262 (e.g., bolt, screw, etc.) (FIGS. 34 and 35). In other constructions, the second hole 1255 may be unthreaded.

FIG. 43 shows that the drive channel 1260 extends through the second end portion 1235 across the body 1230 transverse or perpendicular to the longitudinal axis 1245. The drive channel 1260 is partially defined by a recessed surface 1265. In the illustrated construction, the recessed surface 1265 is substantially planar such that drive channel 1260 is defined by a substantially rectangular cross-section. In other constructions, the drive channel 1260 can include other cross-sectional shapes. The second hole 1255 extends into the body 1230 from the recessed surface 1265.

FIGS. 34 and 40 shows that the cam 1040 is engageable with the plug 1220 via the extension 1035 adjacent the second end portion 1235. In some constructions, the cam 1040 is directly engaged with the plug 1220 without the intervening extension 1035 (FIG. 41). Generally, the extension 1035 is an optional component of the mortise lock assembly 1010 that cooperates with the cam 1040 to provide locking capability of the lock cylinder assembly 1030 when the housing 40 has a relatively long length (e.g., 1.375 inches, 1.5 inches, 1.625 inches, 1.75 inches, etc.). In other words, the extension 1035 extends the length of the plug 1220 so that the plug 1220 can engage the mortise chassis to lock and unlock the door. In constructions of the lock cylinder assembly 1030 that include a relatively short housing 40, the extension 1035 is not necessary to extend the length of the plug 1220 (FIG. 41). In these constructions, the cam 1040 provides the desired locking capability of the lock cylinder assembly 1030 without the extension 1035.

Figure 45:
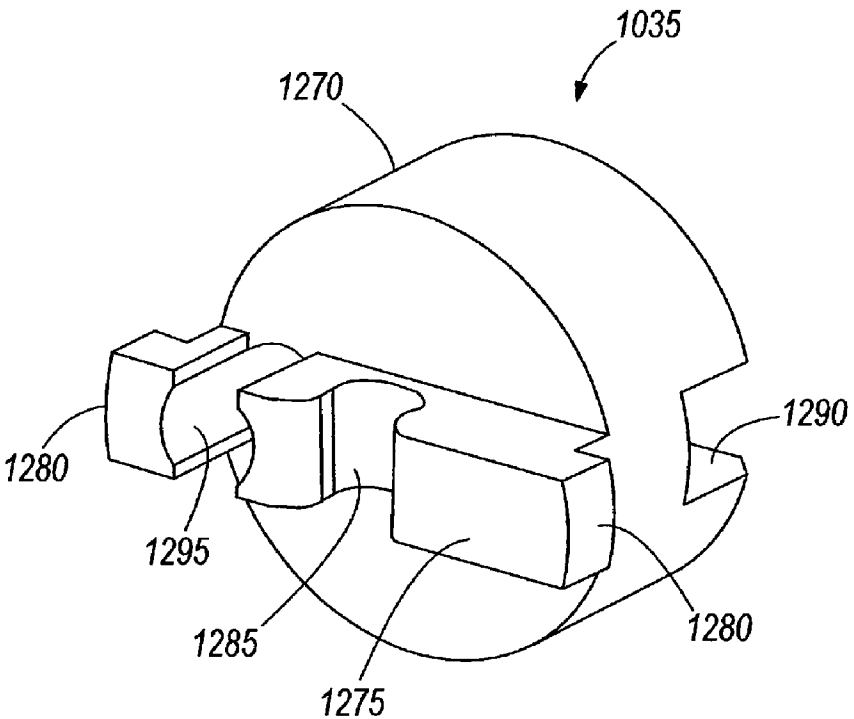
FIG. 45 is another perspective view of the extension.
Figure 44:
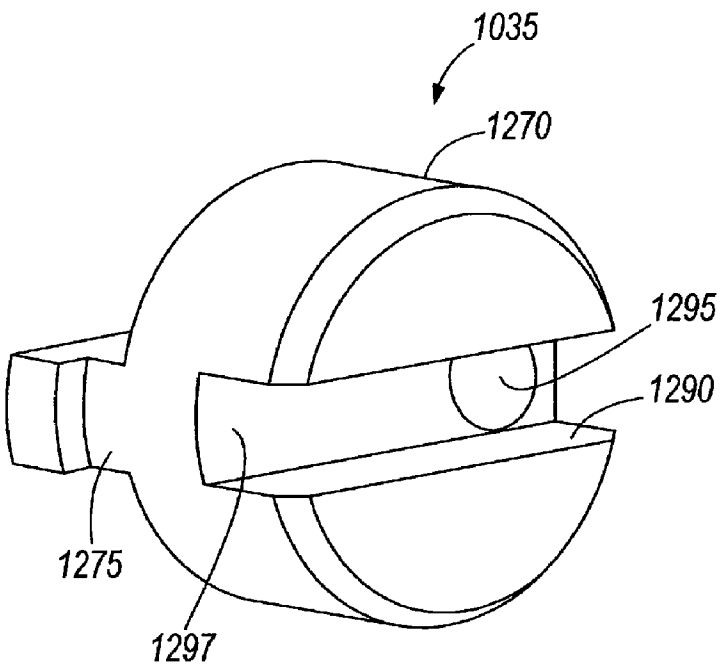
FIG. 44 is a perspective view of the extension of FIG. 35.

FIGS. 44 and 45 show that the extension 1035 includes an extension body 1270 that has an outside diameter, and an extension drive element 1275 that extends from an end of the extension body 1270. FIG. 45 shows that the extension drive element 1275 extends diametrically across the extension body 1270. The extension drive element 1275 is engageable with the drive channel 1260 to indirectly attach the cam 1040 to the plug 1220 so that rotation of the plug 1220 can be transferred to the cam 1040 via the extension 1035.

The extension drive element 1275 includes opposed curved end portions 1280 and a key relief recess 1285. The curved end portions 1280 extend beyond the outside diameter of the extension body 1270, and are engageable with the first cavity 1165 of the second housing portion 1055 to align the extension 1035 with the plug 1220. The key relief recess 1285 is positioned adjacent a center of the extension drive element 1275 to provide relief between the key 1015 and the extension 1035 when the key 1015 is inserted into the key slot 130 (FIG. 40).

As illustrated in FIGS. 44 and 45, the extension body 1270 also includes a drive element slot 1290 and an extension hole 1295. The drive element slot 1290 extends diametrically across the end of the extension body 1270 that is opposite the extension drive element 1275. The drive element slot 1290 is defined by a recessed surface 1297, and has a generally rectangular cross-section. The extension hole 1295 extends completely through the extension body 1270 and the extension drive element 1275, and is aligned with the second hole 1255 of the plug 1220 when the mortise lock assembly 1010 is assembled. The fastener 1262 extends through the extension hole 1295 to attach the cam 1040 to the plug 1220.

Figure 47:
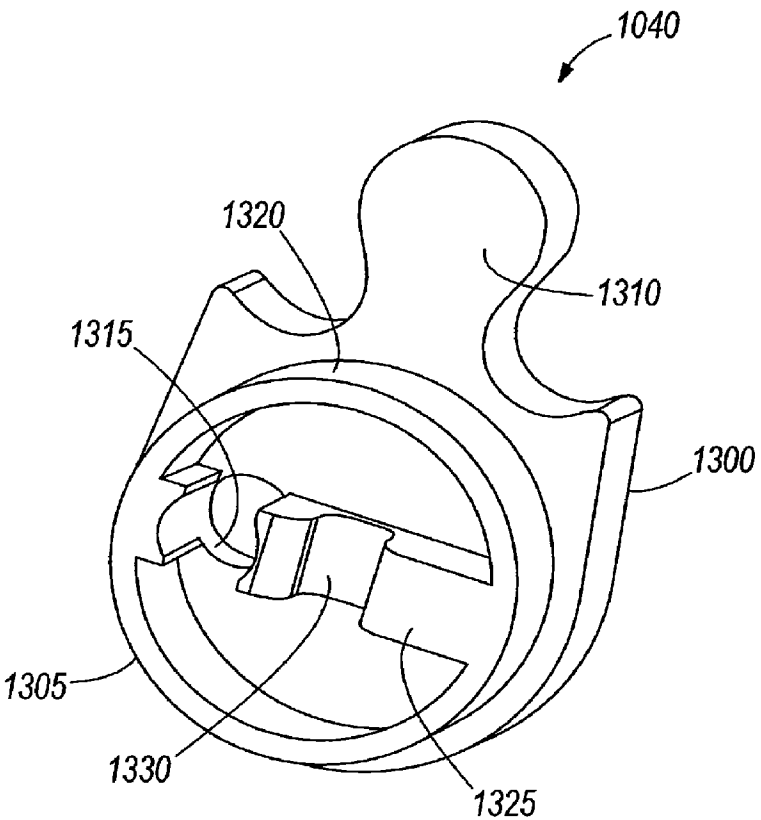
FIG. 47 is another perspective view of the cam.
Figure 46:
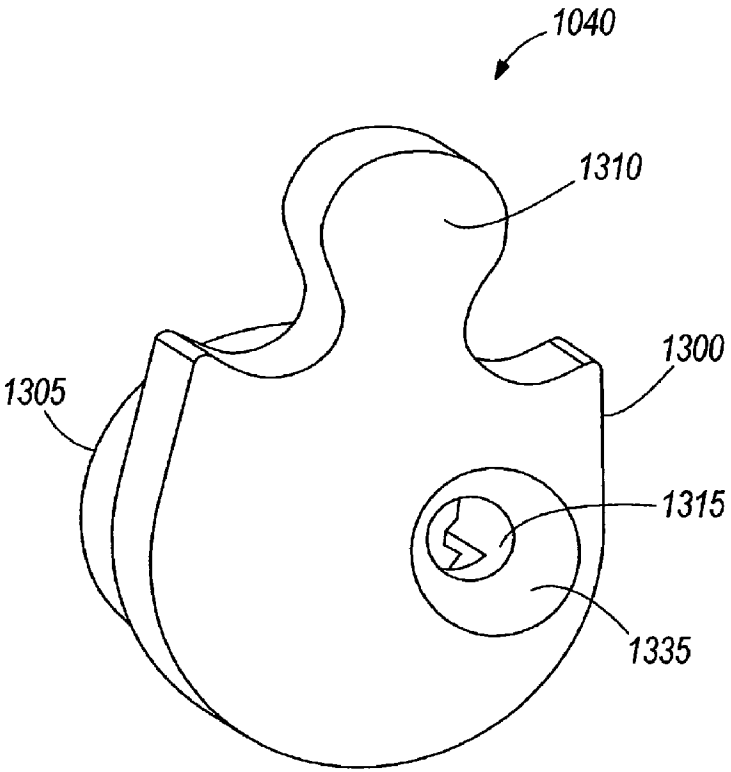
FIG. 46 is a perspective view of the cam of FIG. 35.

FIGS. 34, 40 and 41 show that the cam 1040 is rotatable with the plug 1220 to transfer rotation from the plug 1220 to the mortise chassis. FIGS. 46 and 47 show that the cam 1040 includes a cam body 1300, an engagement member 1305, a lobe 1310, and a cam hole 1315. The engagement member is supported on an end of the cam body 1300. FIG. 47 shows that the engagement member 1305 includes a cylindrical portion 1320 that has an inside diameter, and a cam drive element 1325 that is coupled to the cylindrical portion 1320. The outside diameter of the extension body 1270 is smaller than the inside diameter of the cylindrical portion 1320 so that the extension body 1270 snugly fits into the cylindrical portion 1320 when the cam 1040 is attached to the extension 1035. The cylindrical portion 1320 is generally centered on the cam body 1300 such that the perimeter of the cylindrical portion 1320 is disposed adjacent edges of the cam body 1300. The cylindrical portion 1320 extends outward from the cam body 1300, and is engaged with the first cavity 1165 of the second housing portion 1055 so that the cam 1040 is aligned with the plug 1220.

The cam drive element 1325 is similar to the extension drive element 1275, and generally corresponds to the shape of the drive element slot 1290. When the cam 1040 is attached to the extension 1035, the cam drive element 1325 is disposed in the drive element slot 1290 (FIG. 40). In constructions of the mortise lock assembly 1010 that do not include the extension 1035 (FIG. 41), the cam drive element 1325 is disposed directly in the drive channel 1260 of the plug 1220 so that rotation of the plug 1220 is transferred to directly the cam 1040.

The cam drive element 1325 extends inward from the perimeter of the cylindrical portion 1320 and laterally across the cam body 1300. The cam drive element 1325 includes a key relief recess 1330 that is positioned adjacent a center of the cam drive element 1325 to provide relief between the key 1015 and the cam 1040 when the key 1015 is inserted into the key slot 130. The key relief recess 1330 is similar to the key relief recess 1285 of the extension 1035.

The lobe 1310 extends outward from the cam body 1300 (i.e., upward in FIGS. 46 and 47). The lobe 1310 is engageable with a driver mechanism of the mortise chassis to move the latch and thereby lock and unlock the door in response to rotation of the plug 1220.

The cam hole 1315 extends through the cam body 1300 offset from a center of the cam 1040, and is partially defined by a counter bore 1335. The cam hole 1315 further extends through the cam drive element 1325 so that the fastener 1262 can extend through the cam 1040. The fastener 1262 extends through the cam hole 1315 to attach the cam 1040 to the plug 1220 so that movement of the cam 1040 is dependent on movement of the plug 1220. As illustrated in FIG. 40, in constructions that include the extension 1035, the fastener 1262 also attaches the cam 1040 to the extension 1035.

FIG. 40 shows the mortise lock assembly 1010 with the appropriate key 1015 inserted into the key slot 130. The pin engaging portions 1020 of the appropriate key 1015 are engaged with each of the inner pins 150 to move the outer pins 140 to the shear line 1225. After the outer pins 140 are moved to the shear line 1225, the plug 1220 can be rotated between the locked and unlocked positions.

The mortise lock assembly 1010 is assembled by inserting the plug 1220 into the housing 40 after the inner pins 150 have been positioned in the plug 1220, similar to the assembly of the KIK lock assembly 10. The assembled lock cylinder assembly 1030 is inserted into the first and second cavities of the second housing portion 1055. The second housing portion 1055 and the lock cylinder assembly 1030 are attached to the first housing portion 1050 by inserting the lock cylinder assembly 1030 into the cavity 1100. The plug 1220 is accessible through the first cavity portion 1105, and the pin portion 70 of the housing 40 abuts the end of the second cavity portion 1110. The second housing portion 1055 is attached to the first housing portion 1050 using the fasteners 1057, which are inserted through the holes 1180 of the second housing portion 1055 and into the holes 1140 defined by the housing attachment portions 1130 to rigidly secure the second housing portion 1055 to the first housing portion 1050. The anti-tamper plate 1045, if included in the mortise lock assembly 1010, can be inserted into the anti-tamper slot 1090 at any time during assembly of the mortise lock assembly 1010.

In constructions of the mortise lock assembly 1010 in which the extension 1035 is included, the extension 1035 is engaged with the plug 1220 within the drive channel 1260. Next, the cam 1040 is engaged with the extension 1035 via the engagement member 1305 and the drive element slot 1290. The cylindrical portion 1320 is engaged with the extension body 1270 when the cam 1040 is attached to the extension 1035. The fastener 1262 is inserted through the extension and cam holes 1295, 1315 to attach the cam 1040 and the extension 1035 to the plug 1220.

Alternatively, in constructions in which the extension 1035 is not included, the cam 1040 is directly engaged with the plug 1220 by inserting the engagement member 1305 into the second cavity 1170, and engaging the cam drive element 1325 with the drive channel 1260. In this construction, the fastener 1262 is inserted through the cam hole 1315 to attach the cam 1040 to the plug 1220. The assembled mortise lock assembly 1010 is threaded into the mortise chassis so that the lobe 1310 is engaged with the driver mechanism.

Except as described below, operation of the mortise lock assembly 1010 is similar to the operation KIK lock assembly 10 that is described with regard to FIGS. 1-5. Generally, the mortise lock cylinder assembly 1030 is inserted into the mortise housing 1025, as described above. When the appropriate key 1015 is inserted into the key slot 130, the pin engaging portions 1020 engage the inner pins 150 to move the outer pins 140 to the shear line 1225. The plug 1220 can be rotated after the outer pins 140 are aligned with the shear line 1225, which in turn rotates the extension 1035 and the cam 1040. Rotation of the cam 1040 engages the lobe 1310 with the driver mechanism to move the latch between the locked and unlocked positions.

The housing 40 is universal among the different lock assemblies. In other words, the housing 40 is not specific to a particular lock type design, and the housing 40 can be used in the KIK lock assembly 10, the IC lock assembly 310, and the mortise lock assembly 1010 without modification. For example, the housing 40 can be removed from the KIK lock assembly 10 and used in the IC lock assembly 310 or the mortise lock assembly 1010. The housing 40 accommodates the components that are used in KIK lock assemblies, IC lock assemblies, and mortise lock assemblies without additional manufacturing processes (e.g., machining, tooling, etc.). Generally, the housing 40 can be transferred from any one of the KIK lock assembly 10, the IC lock assembly 310, and the mortise lock assembly 1010 to another of the KIK lock assembly 10, the IC lock assembly 310, and the mortise lock assembly 1010 without modification, and without added manufacturing processes or tooling. The transferable housing 40 reduces the complexity of lock assemblies, and limits costs of manufacturing by limiting the number of different components that are needed for different lock types.

In some constructions, the housing 40 and the plug 45 that are used in the KIK lock assembly 10 can be universal among the different lock assemblies. The housing 40 and the plug 45 can accommodate the different characteristics and components of the KIK lock assembly 10, the IC lock assembly 310, and the mortise lock assembly 1010 without modification to reduce the complexity of lock assemblies, and to limit costs of manufacturing.

FIGS. 48-56 show an assembly housing 1420, a cam member 1430, and a retainer clip 1435 for use with the lock assemblies 10, 310, 1010, or other lock assemblies. For the sake of brevity, the assembly housing 1420, the cam member 1430, and the retainer clip 1435 are described below with regard to the lock assembly 310 and the IC lock cylinder assembly 325 (see FIGS. 6-23). It should be understood that the features of the assembly housing 1420 described herein may be incorporated into assembly housings of other lock assemblies (e.g., key-in-knob lock assemblies, mortise lock assemblies, etc.). Furthermore, it should be understood that the cam member 1430 and the retainer clip 1435 are generally universal components that may be used with various lock assemblies.

Figure 48:
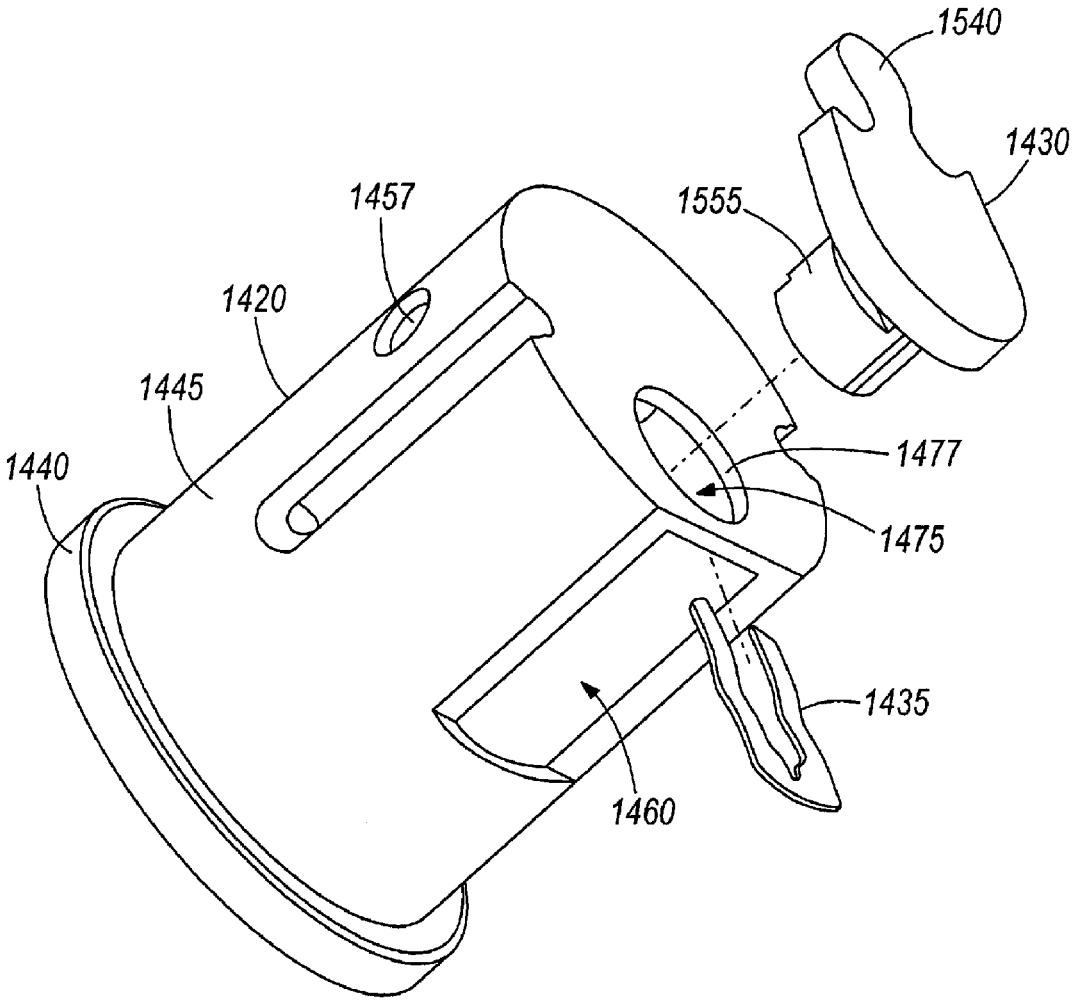
FIG. 48 is an exploded perspective view of a lock assembly housing, a cam member, and a retainer clip.
Figure 49:
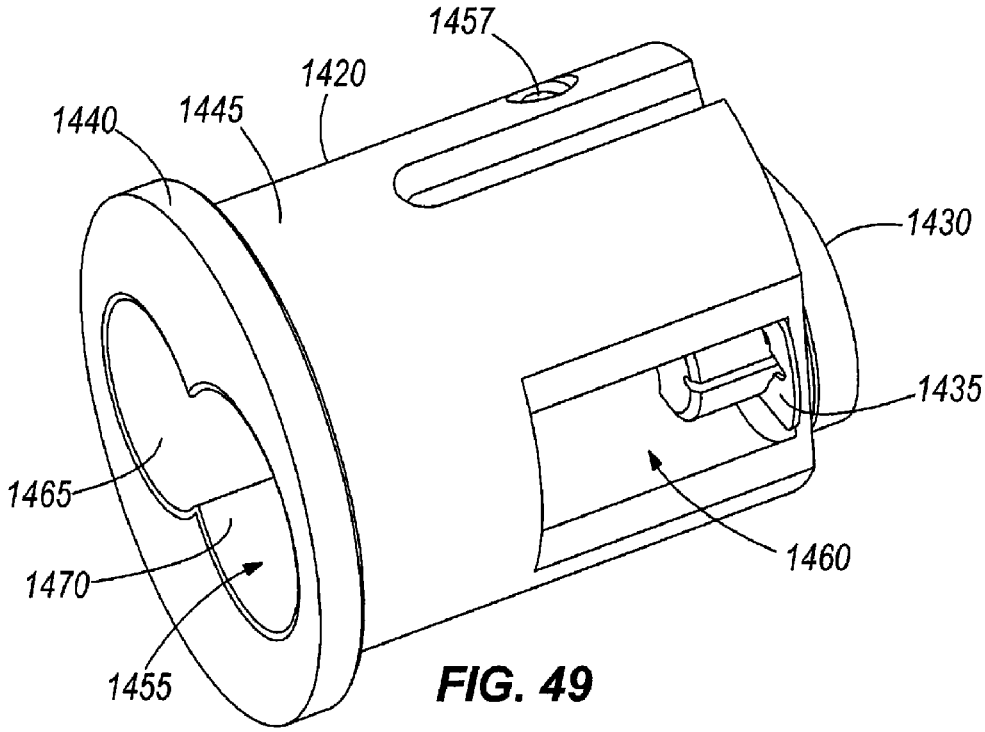
FIG. 49 is an unexploded perspective view of the lock assembly housing, the cam member, and the retainer clip.
Figure 50:
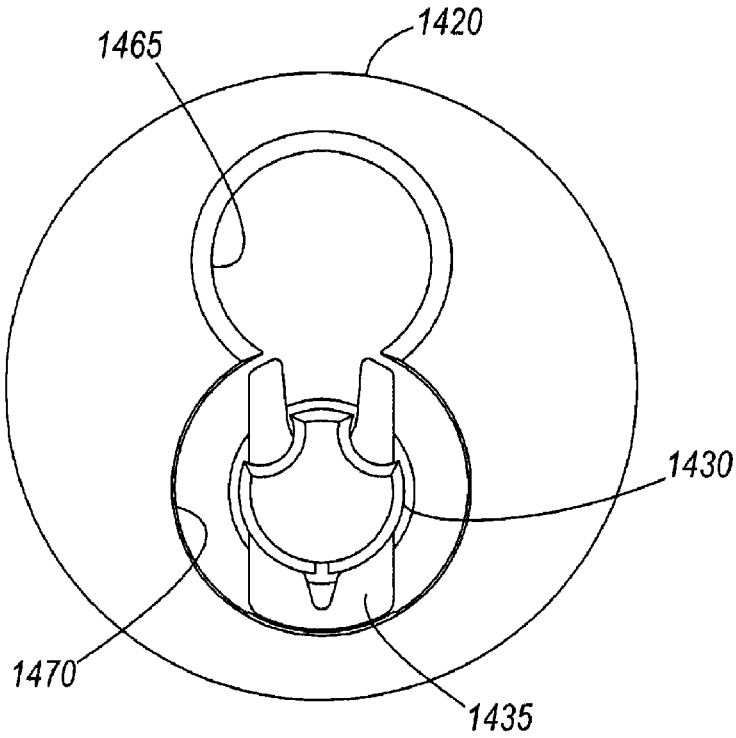
FIG. 50 is a front view of the lock assembly housing, the cam member, and the retainer clip of FIG. 49.

As illustrated in FIGS. 48-50, the assembly housing 1420 includes a rim 1440 that defines a first end of the assembly housing 1420 and that abuts a surface of the door, and a housing body 1445 that extends from the rim 1440 and that defines a second end of the assembly housing 1420. The housing body 1445 engages the inside of the door, and defines a second end of the assembly housing 1420 that is opposite the rim 1440. The housing body 1445 includes diametrically opposed locking channels 1450 that can be engaged by fasteners (e.g., screws, bolts, etc.) in the door to lock the assembly housing 1420 from rotation after the assembly housing 1420 is engaged with the door.

The assembly housing 1420 also includes a cavity 1455, a locking hole 1457, and a housing opening or aperture 1460. The cavity 1455 has a substantially "figure-eight" shaped cross-section that is defined by a first interior surface 1465 and a second interior surface 1470. As illustrated in FIGS. 49 and 50, the upper portion of the cavity 1455 defined by the first interior surface 1465 extends from the first end toward the second end of the assembly housing 1420. A cam hole 1475 that is defined by a surface 1477 extends through the second end of the assembly housing 1420, and is in communication with the lower portion of the cavity 1455 that is defined by the second interior surface 1470.

The locking hole 1457 is disposed in the first interior surface 1465 adjacent the second end of the assembly housing 1420. The housing aperture 1460 extends through the housing body 1445 in communication with the cavity 1455, and also extends from the second end of the assembly housing 1420 toward the first end.

FIGS. 49 and 50 show that the cam member 1430 is coupled to the second end of the assembly housing 1420. The cam member 1430 extends through the cam hole 1475 to engage the plug 360, and is rotatable with the plug 360 to transfer rotation from the plug 360 to a lock chassis (not shown) in the door. The cam member 1430 is formed as a single piece from any suitable material (e.g., metal, plastic, etc.) using any suitable manufacturing processes (e.g., zinc die casting, molding, machining, etc.).

FIGS. 51-54 show that the cam member 1430 includes a cam body 1535 that defines a lobe or latch engagement member 1540 and a transition or bearing surface 1545. The lobe 1540 is engageable with the lock chassis to move a latch in the door to lock and unlock the door in response to rotation of the plug 360. The bearing surface 1545 spaces the cam body 1535 from the housing body 1445 to permit substantially unimpeded rotation of the cam member 1430 relative to the housing body 1445.

The cam member 1430 also includes an alignment bearing 1550 that extends outward from the cam body 1535 and a drive element or engagement member 1555 that extends outward from the alignment bearing 1550. The alignment bearing 1550 includes a first surface 1560 and a second surface 1565. The first surface 1560 is engageable with the surface 1477 that defines the cam hole 1475 to maintain axial alignment of the drive element 1555 with the plug 360 so that rotational movement of the plug 360 can be transferred to the lock chassis via the cam member 1430.

The drive element 1555 is substantially cylindrical and is in communication with the cavity 1455 such that the drive element 1555 can be engaged with the IC lock cylinder assembly 325 within the end of the plug 360. The drive element 1555 includes substantially cylindrical outer surfaces 1567 that engage an inner surface of the plug 360. As shown in FIGS. 51-54, the drive element 1555 also includes opposed engagement recesses 1570, opposed retainer slots 1575, and a clearance slot or groove 1580. The opposed engagement recesses 1570 and the opposed retainer slots 1575 are symmetrical about an axis 1585 that extends through the cam member 1430.

Figure 51:
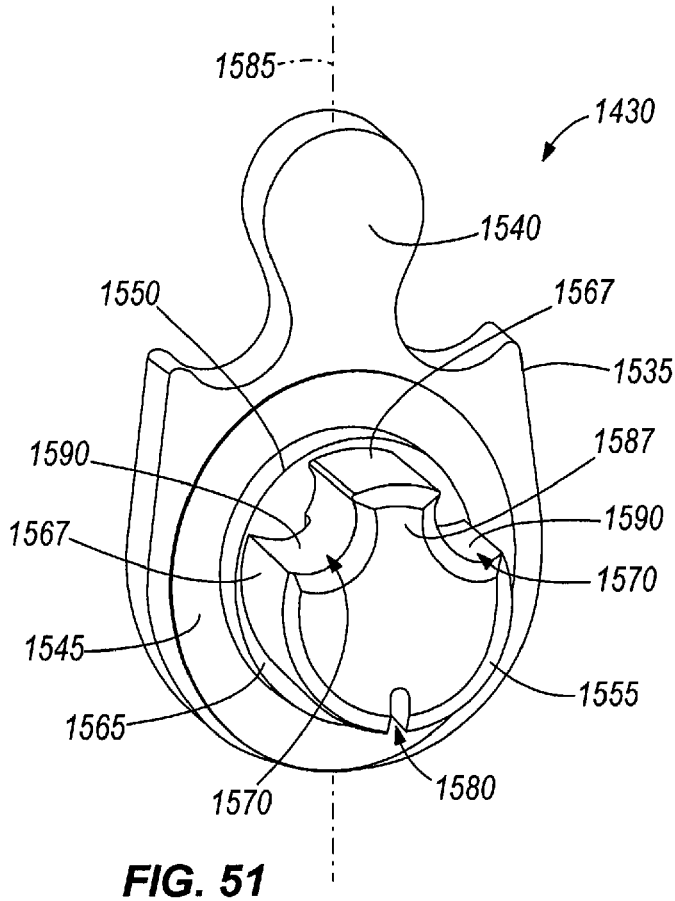
FIG. 51 is a perspective view of the cam member.
Figure 52:
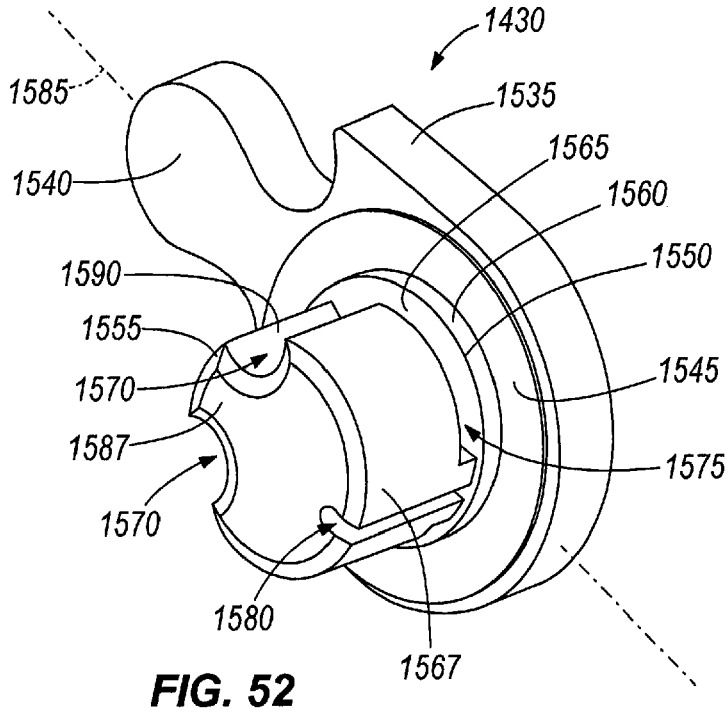
FIG. 52 is another perspective view of the cam member.
Figure 54:
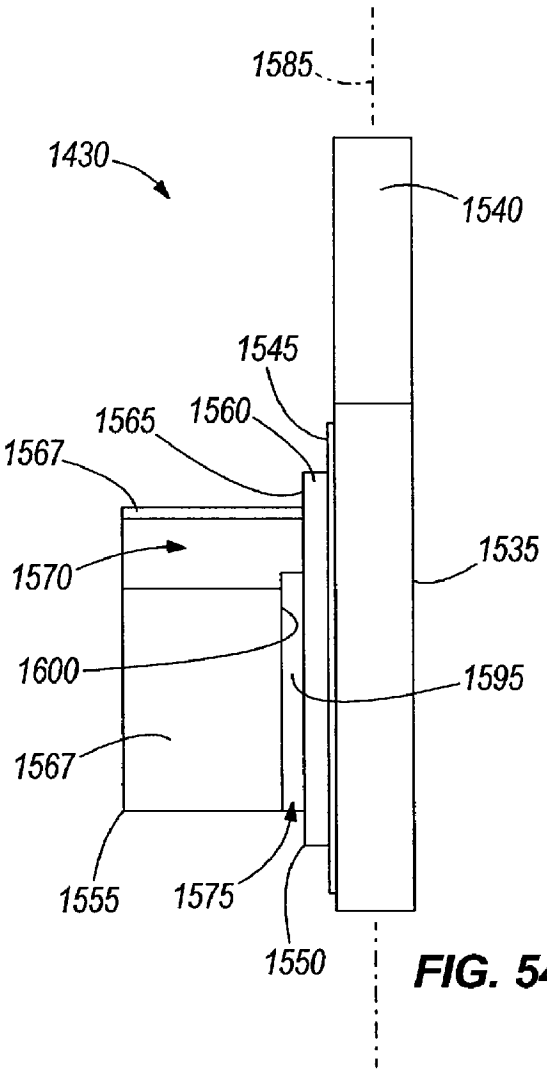
FIG. 54 is a side view of the cam member of FIG. 51.

With regard to FIGS. 51, 52, and 54, the engagement recesses 1570 are separated from each other by a drive element portion 1587, and extend along the drive element 1555 substantially perpendicular to the axis 1585. The engagement recesses 1570 are defined by curved surfaces 1590 that extend from an outer end of the drive element 1555 to the alignment bearing 1550 adjacent an inner end of the drive element 1555. The curved surfaces 1590 are engageable by the alignment pin 1530 to transfer rotation of the plug 360 to the cam member 1430 so that the door can be locked and unlocked.

Figure 53:
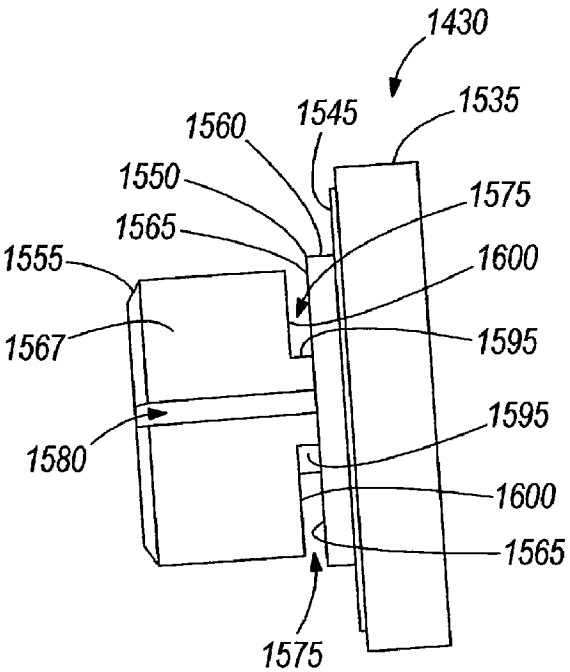
FIG. 53 is a bottom view of the cam member of FIG. 51.

FIGS. 53 and 54 show that the retainer slots 1575 extend through the drive element 1555 adjacent the alignment bearing 1550 at an inner end of the drive element 1555 substantially parallel to or along the axis 1585. The retainer slots 1575 are symmetrically opposed from each other about the axis 1585. The retainer slots 1575 have rectangular cross-sections, and are defined by the second surface 1565 of the alignment bearing 1550, bridge surfaces 1595 of the drive element 1555, and drive element surfaces 1600 of the drive element 1555 that are disposed opposite the second surface 1565. FIGS. 51-54 show that the retainer slots 1575 are in communication with the engagement recesses 1570, and are shaped to receive the retainer clip 1435.

The clearance groove 1580 is disposed in one of the outer surfaces 1567 of the drive element 1555 (i.e., along the bottom of the drive element 1555 as viewed in FIG. 53), and extends through the drive element 1555 from the outer end to the inner end substantially perpendicular to the axis 1585. The clearance groove 1580 is a shallow recess that receives a retainer clip removal tool (not shown) that is operable to detach the retainer clip 1435 from the cam member 1430.

Figure 56:
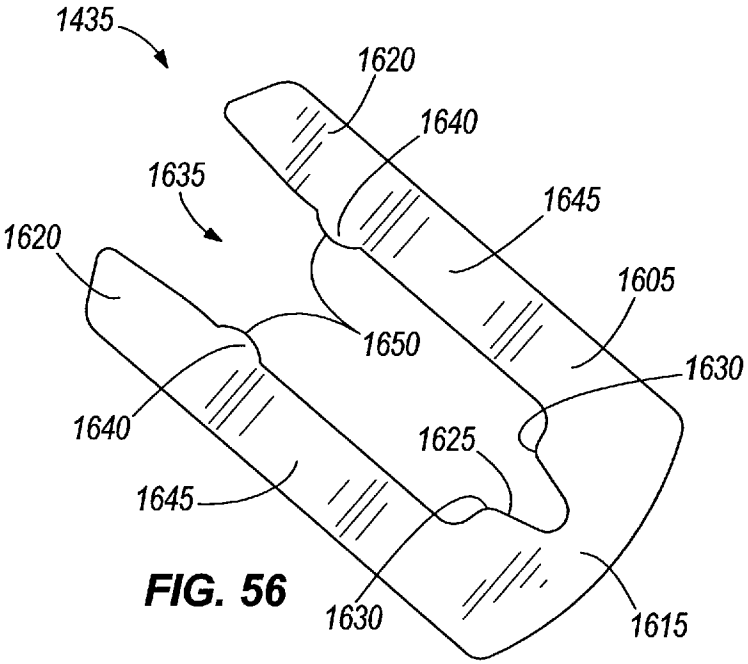
FIG. 56 is a top view of the retainer clip of FIG. 55.
Figure 55:
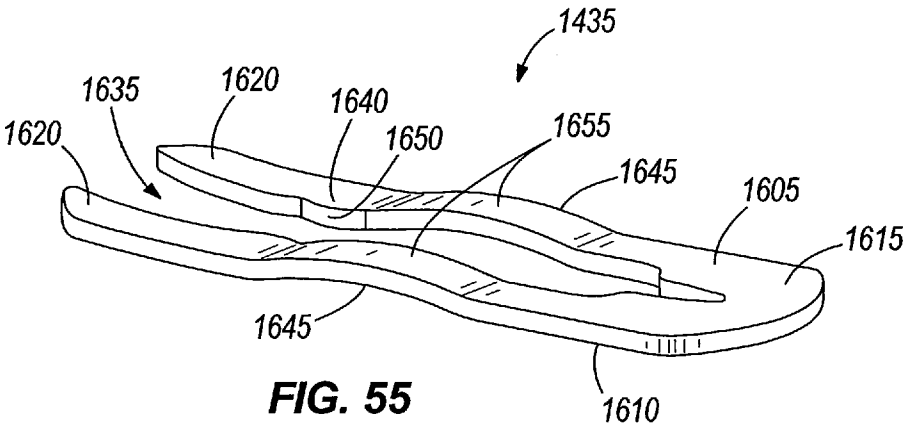
FIG. 55 is a perspective view of the retainer clip.

FIGS. 49 and 50 show that the retainer clip 1435 is attached to the cam member 1430 to retain the cam member 1430 in engagement with the assembly housing 1420 while allowing rotation of the cam member 1430 relative to the assembly housing 1420. FIGS. 55 and 56 show that the retainer clip 1435 is substantially "U"-shaped. In the illustrated construction, the retainer clip 1435 is formed from a relatively thin material that has spring-like characteristics (e.g., metal, plastic, etc.). In other constructions, the retainer clip 1435 can be formed from other suitable materials.

FIGS. 55 and 56 show that the retainer clip 1435 includes a first surface 1605, a second surface 1610 that is opposite the first surface 1605, a central portion 1615, and two opposed retainer arms 1620. The central portion 1615 defines a tool slot 1625 that is substantially aligned with the clearance groove 1580 when the retainer clip 1435 is attached to the cam member 1430. The tool slot 1625 is formed to receive an end of the retainer clip removal tool to facilitate removal of the retainer clip 1435 from the cam member 1430. The central portion 1615 also includes opposed corner portions 1630 that are disposed on opposite sides of the tool slot 1625 and that engage one of the cylindrical surfaces 1567 of the drive element 1555 when the retainer clip 1435 is attached to the cam member 1430 to provide the gap that allows insertion of the removal tool into the tool slot 1625.

The opposed retainer arms 1620 extend from the central portion 1615 and are spaced apart from each other such that the retainer arms 1620 define a channel 1635. Each retainer arm 1620 includes an extension 1640 that is disposed adjacent an end of the corresponding retainer arm 1620, and an arcuate portion 1645 that is disposed adjacent a middle of the corresponding retainer arm 1620. As illustrated in FIG. 56, each extension 1640 is positioned adjacent an end of the associated arcuate portion 1645. Generally, the extensions 1640 are spaced from the central portion 1615 so that the extensions 1640 are substantially engaged with the engagement recesses 1570 after attachment of the retainer clip 1435 to the cam member 1430. As illustrated in FIG. 55, each extension 1640 is defined by a curved surface profile 1650 that protrudes from an inward edge of the retainer arm 1620 into the channel 1635. In other constructions, the extensions 1640 can be defined by other profile shapes.

The arcuate portions 1645 are raised resistance arcs of the retainer clip 1435, and include curved surface profiles 1655 that extend beyond a plane defined by the first surface 1605. In some constructions, the curved surface profile 1655 of each arcuate portion 1645 engages the corresponding drive element surface 1600 of the drive element 1555, which holds the cam member 1430 in engagement with the housing body 1445. In these constructions, the second surface 1610 of the retainer clip 1435 engages the second surface 1565 of the alignment bearing 1550. In other constructions, the curved surface profiles 1655 can engage the second surface 1565 of the alignment bearing 1550 to hold the cam member 1430 in engagement with the housing body 1445. In these constructions, the first surface 1605 of the retainer clip 1435 engages the corresponding drive element surface 1600 of the drive element 1555. Generally, the arcuate portions 1645 resist rotation of the cam member 1430 when the IC lock cylinder assembly 325 is removed from the assembly housing 1420, which in turn inhibits undesired movement of the latch between the locked and unlocked positions.

The lock assembly 310 is assembled by engaging the cam member 1430 with the assembly housing 1420 via the cam hole 1475, and attaching the retainer clip 1435 to the cam member 1430 via the retainer slots 1575. After the drive element 1555 is inserted into the assembly housing 1420, the retainer clip 1435 is inserted into the assembly housing 1420 through the housing aperture 1460 in the bottom of the assembly housing 1420. When the retainer clip 1435 is attached to the cam member 1430, the retainer arms 1620 engage the drive element 1555 within the retainer slots 1575. The extensions 1640 slide along the bridge surfaces 1595 and snap into engagement with the curved surfaces 1590 of the engagement recesses 1570 to securely attach the retainer clip 1435 to the cam member 1430.

After the extensions 1640 snap into place, the curved surface profiles 1650 of the extensions 1640 resist removal of the retainer clip 1435 from the cam member 1430 without the use of the retainer clip 1435 removal tool. Depending on the orientation of the retainer clip 1435 upon insertion into the retainer slots 1575 (i.e., whether the arcuate portions 1645 engage the drive element surfaces 1600, or the second surface 1565 of the alignment bearing 1550), the second surface 1610 of the retainer clip 1435 is engaged with one of the second surface 1565 and the drive element surfaces 1600. Engagement of the arcuate portions 1645 with the cam member 1430 limits movement of the cam member 1430 into and out of the assembly housing 1420, and also limits undesired rotation of the cam member 1430.

The IC lock cylinder assembly 325 can be inserted into the cavity 1455 before or after the cam member 1430 is attached to the assembly housing 1420. When the IC lock cylinder assembly 325 is inserted into the cavity 1455, the plug 360 engages the cam member 1430 within one of the engagement recesses 1570. Engagement of the cam member 1430 with the plug 360 causes rotation of the cam member 1430 to depend on rotation of the plug 360.

In operation of the lock assembly 310, the appropriate key 315 is inserted into the key slot 130, which allows the plug 360 to be rotated between the locked position and the unlocked position. Rotation of the plug 360 using the appropriate key 315 rotates the drive element 1555, which in turn causes rotation of the lobe 1540. The lobe 1540 is rotated and engaged with the lock chassis to move the latch between the locked and unlocked positions. The arcuate portions 1645 resist rotation of the cam member 1430 during removal of the IC lock cylinder assembly 325 to inhibit undesired movement of the latch between the locked and unlocked positions. In this manner, the retainer clip 1435 opposes rotation of the cam member 1430 that can be caused by removal of the IC lock cylinder assembly 325 from the assembly housing 1420.

The retainer clip 1435 is disengaged from the assembly housing 1420 by inserting the retainer clip 1435 removal tool into the cavity 1455, into the clearance groove 1580, and into engagement with the tool slot 1625 of the retainer clip 1435. In the illustrated construction, a generally downward force is applied to the retainer clip 1435 using the removal tool to disengage the extensions 1640 from engagement recesses 1570. After the extensions 1640 are disengaged from the engagement recesses 1570, the retainer clip 1435 is removed from the retainer slots 1575 through the housing aperture 1460 in the bottom of the assembly housing 1420. The cam member 1430 can be detached from the assembly housing 1420 after the retainer clip 1435 is removed from the drive element 1555.

Generally, the one-piece cam member 1430 and the retainer clip 1435 simplify assembly and disassembly of the lock assembly 310, as well as operation of the lock assembly 310. During assembly of the lock assembly 310, the cam member 1430 and the retainer clip 1435 allow fewer components to be used to transfer rotation from the plug 360 to the lock chassis without additional manufacturing processes. During operation of the lock assembly 310, the cam member 1430 and the retainer clip 1435 transfer rotational movement of the plug 360 to the lock chassis without susceptibility of the attachment between the cam member 1430 and the assembly housing 1420 becoming loose over time. The single-piece cam member 1430 and the retainer clip 1435 reduce the complexity of lock assembly 310, and limit costs of manufacturing by limiting the number of different components that are needed to transfer rotation of the plug 360 to the lock chassis.

Various features and advantages of the invention are set forth in the following claims.

What is claimed is:

1. A method of manufacturing a lock assembly for enabling use of a key-in-knob lock cylinder assembly in different types of lock assemblies, the method comprising:

providing a key-in-knob lock assembly including a key-in-knob housing having a pin portion defining at least two outer pin chambers receiving outer pins, the lock assembly further including a plug rotatably engaged within the key-in-knob housing;

providing an interchangeable core lock assembly including an interchangeable core housing defining a figure-eight-shaped cavity;

providing an adapter including a curved profile conforming to an upper portion of the figure-eight-shaped cavity and a pin supported by the adapter;

removably attaching the adapter to the key-in-knob housing over the pin portion;

inserting the key-in-knob housing into the interchangeable core housing so that the pin portion and the adapter are disposed in the upper portion of the figure-eight shaped cavity and the plug is disposed in a lower portion of the figure-eight shaped cavity such that the key-in-knob housing is universally exchangeable between the key-in-knob lock assembly and the interchangeable core lock assembly; and removably securing the key-in-knob housing in the interchangeable core housing by engaging and disengaging the pin relative to a locking hole of the interchangeable core housing.

2. The method of claim 1, further comprising:

providing a mortise lock assembly including a mortise housing; and transferring the key-in-knob housing from the interchangeable core housing to the mortise housing such that the key-in-knob housing is universally exchangeable between the key-in-knob lock assembly, the interchangeable core lock assembly, and the mortise lock assembly.

3. The method of claim 1, wherein the transferring step includes removing the key-in-knob housing from the interchangeable core housing; and inserting the key-in-knob housing into the mortise housing.

4. The method of claim 2, further comprising:

providing the mortise lock assembly with a first housing portion and a second housing portion; and inserting the key-in-knob housing into the first housing portion;

enclosing the key-in-knob housing in the mortise housing with the second housing portion.

5. The method of claim 1, further comprising biasing the pin into the locking hole.

6. The method of claim 1, further comprising:

actuating a control pin; and rotating the plug to engage and disengage the pin relative to the locking hole.

7. The method of claim 6, wherein actuating the control pin includes inserting a control key into a key slot of the plug, the method further comprising removing the control key from the key slot without rotating the plug after the pin is engaged with the locking hole.

8. The method of claim 1, further comprising sliding the adapter onto the key-in-knob housing.

9. The method of claim 8, further comprising removably securing a faceplate onto the key-in-knob assembly to attach the adapter to the key-in-knob housing.

10. A key-in-knob lock cylinder assembly comprising:

a key-in-knob housing defining a cylindrical cavity and having a pin portion defining an outer pin chamber communicating with the cavity, the outer pin chamber being adapted to house an outer pin;

a plug disposed in the cavity and being rotatable within the cavity between a locked position and an unlocked position, the plug having an inner pin chamber aligned with the outer pin chamber when the plug is in the locked position;

an adapter removably attachable to the pin portion and including a curved profile; and a pin supported by the adapter, wherein at least one of the key-in-knob housing and the plug is exchangeable between a key-in-knob lock assembly and at least one of an interchangeable core lock assembly and a mortise lock assembly, the interchangeable core lock assembly including an interchangeable core housing defining a locking hole, and wherein the pin is engageable and disengageable relative to the locking hole to removably secure at least one of the key-in-knob housing and the plug in the interchangeable core housing.

11. The key-in-knob lock cylinder assembly of claim 10, further comprising one of a cam and a tailpiece coupled to the key-in-knob plug, wherein each of the cam and the tailpiece is exchangeable between the key-in-knob lock assembly and at least one of the interchangeable core lock assembly and the mortise lock assembly.

12. An interchangeable core lock assembly comprising:

an interchangeable core housing having a housing body defining cavity with a figure-eight cross section, and a locking hole extending into the housing body from adjacent an upper portion of the cavity;

an interchangeable core lock cylinder assembly including a key-in-knob housing having a wall defining a hollow portion, and a pin portion defining at least two outer pin chambers receiving outer pins, a plug having a body rotatably housed within the hollow portion of the housing, a key slot disposed at least partially through the body, at least two inner pin chambers disposed within the body and in communication with the key slot, the at least two inner pin chambers receiving inner pins, the plug further having a pin receiving chamber receiving a control pin, and an actuating mechanism engageable by the control pin and having an actuating pin holder, an actuating ring, an actuating pin engageable with the locking hole, and a connector pin, the actuating pin holder having a holder body, an insertion guide, and an insertion channel extending partially through the holder body, the actuating pin holder removably engaged with the pin portion via the insertion channel such that the actuating pin holder is removably secured to the key-in-knob housing.

13. The interchangeable core lock assembly of claim 12, wherein the pin receiving chamber is in communication with the key slot and offset from the at least two inner pin chambers such that the pin receiving chamber is not longitudinally aligned with the at least two inner pin chambers.

14. The interchangeable core lock assembly of claim 13, wherein the control pin extends into the key slot and is engageable by a control key after insertion of the control key into the key slot.

15. The interchangeable core lock assembly of claim 14, wherein the actuating mechanism is movable between a locked position and an unlocked position using the control key to selectively lock the interchangeable core lock cylinder assembly into the interchangeable core housing.

16. The interchangeable core lock assembly of claim 12, wherein the actuating pin holder includes a passageway offset from a longitudinal center of the actuating pin holder and extending through the holder body, and wherein a stop pin is disposed in the passageway and selectively engageable with the actuating pin and by the connector pin to selectively allow pivotal movement of the connector pin relative to the actuating pin holder.

17. The interchangeable core lock assembly of claim 12, wherein the pin portion includes an insertion slot, wherein the actuating pin holder includes an insertion rail protruding into the insertion channel, and wherein the insertion rail is engageable with the pin portion within the insertion slot to attach the actuating pin holder to the key-in-knob housing.

18. The interchangeable core lock assembly of claim 17, wherein the insertion slot extends from an outer end of the pin portion toward the wall, and wherein the insertion rail extends through the actuating holder along a side of the insertion channel.

19. The interchangeable core lock assembly of claim 12, further comprising a face plate engaged with the key-in-knob housing to removably secure the actuating pin holder to the key-in-knob housing.

20. The interchangeable core lock assembly of claim 19, wherein the face plate is integrally formed with the actuating pin holder.

21. The interchangeable core lock assembly of claim 19, wherein the face plate is formed from a hardened material resistant to tampering.

22. The interchangeable core lock assembly of claim 19, further comprising an anti-tamper plate disposed in the face plate and press fit into the insertion guide to secure the actuating pin holder to the housing and to resist tampering.

23. The interchangeable core lock assembly of claim 12, wherein the actuating pin includes a first body portion having a first diameter and a second body portion having a second diameter smaller than the first diameter to avoid interference between the second body portion and a portion of the housing body adjacent the locking hole when the actuating pin is moved to an engaged position.

24. The interchangeable core lock assembly of claim 23, wherein the actuating pin is biased into the locking hole.

25. The interchangeable core lock assembly of claim 12, wherein the actuating ring is disposed on the plug and pivotable relative to the key-in-knob housing via rotation of the plug.

26. The interchangeable core lock assembly of claim 25, wherein the actuating ring is at least partially held on the plug by a screw cap.

27. The interchangeable core lock assembly of claim 12, wherein the connector pin is coupled to the actuating ring to engage the actuating pin to selectively move the actuating pin between an engaged position and a disengaged position.

28. The interchangeable core lock assembly of claim 27, wherein the connector pin is engageable by the control pin to move the connector pin between a first position in which a portion of the connector pin is substantially engaged with the actuating ring, and a second position in which the portion of the connector pin is spaced a relatively small distance from the actuating ring.

29. The interchangeable core lock assembly of claim 12, wherein the actuating pin is disposed in a passageway of the actuating pin holder and is defined by a shape conforming to the shape of the passageway to minimize stress on the actuating pin holder and the actuating pin.

* * * * *